US008276523B2

(12) United States Patent
Miller et al.

(10) Patent No.: US 8,276,523 B2
(45) Date of Patent: Oct. 2, 2012

(54) WORKSURFACE ASSEMBLY

(75) Inventors: Scott M Miller, Middleville, MI (US); Robert J Battey, Middleville, MI (US); Todd T Andres, Sparta, MI (US); John R Hamilton, San Rafael, CA (US); Daniel N Phillips, Kentwood, MI (US); Jamie L Payne, Grand Rapids, MI (US); Brian L Bultsma, Byron Center, MI (US); Daniel R Tatman, Jenison, MI (US); Mark T Slager, Caledonia, MI (US); Kurt R Heidmann, Grand Rapids, MI (US); James D Houda, Byron Center, MI (US); David J Dekker, Holland, MI (US); Michael P Kelley, Rockford, MI (US)

(73) Assignee: Steelcase Inc., Grand Rapids, MI (US)

( * ) Notice: Subject to any disclaimer, the term of this patent is extended or adjusted under 35 U.S.C. 154(b) by 348 days.

(21) Appl. No.: 12/471,874

(22) Filed: May 26, 2009

(65) Prior Publication Data

US 2009/0293773 A1 Dec. 3, 2009

Related U.S. Application Data

(60) Provisional application No. 61/056,739, filed on May 28, 2008.

(51) Int. Cl.
*A47B 37/00* (2006.01)

(52) U.S. Cl. ..... 108/50.02; 312/223.6; 312/223.3

(58) Field of Classification Search ..... 108/143, 108/64, 50.01, 50.02, 23; 312/195, 196, 312/223.6, 223.1, 223.3
See application file for complete search history.

(56) References Cited

U.S. PATENT DOCUMENTS

| | | | |
|---|---|---|---|
| 399,752 | A | 3/1889 | Horrocks |
| 775,724 | A | 11/1904 | Gibbes |
| 905,137 | A | 12/1908 | Benjamin |
| 910,659 | A | 1/1909 | Ford |
| 918,780 | A | 4/1909 | Shier |
| 1,258,230 | A | 3/1918 | Eisenhart |
| 1,315,922 | A | 9/1919 | Franklin |
| 1,914,767 | A | 6/1933 | Beckwith |
| 2,328,019 | A | 8/1943 | Jones |

(Continued)

FOREIGN PATENT DOCUMENTS

| | | |
|---|---|---|
| JP | 11234874 | 8/1999 |

(Continued)

OTHER PUBLICATIONS

International Search Report, PCTUS2009/045172, Jan. 12, 2010, 3 Pages.

*Primary Examiner* — Jose V Chen
(74) *Attorney, Agent, or Firm* — Price Heneveld LLP

(57) ABSTRACT

A worksurface assembly includes a support structure and a top portion that is movable relative to the support structure. The worksurface assembly may include a mounting rail configured to support various accessory units. A utility supply system is provided, and the top portion of the worksurface assembly may be moved to provide access to the utility supply system. A mechanism provides for controlled movement of the top portion of the worksurface assembly relative to the support structure.

28 Claims, 28 Drawing Sheets

U.S. PATENT DOCUMENTS

| | | | | | |
|---|---|---|---|---|---|
| 2,351,386 | A | | 6/1944 | Zucker | |
| 2,385,165 | A | | 9/1945 | Sears | |
| 2,449,433 | A | | 9/1948 | Wheelock | |
| 2,573,496 | A | | 10/1951 | Runkle | |
| 2,664,331 | A | | 12/1953 | Glotfelter | |
| 2,751,269 | A | | 6/1956 | Hafekost | |
| 2,770,286 | A | | 11/1956 | Weller | |
| 2,869,952 | A | | 1/1959 | Saunders | |
| 2,984,532 | A | | 5/1961 | Vincens | |
| 3,095,667 | A | | 7/1963 | Huff | |
| 3,152,716 | A | | 10/1964 | Feldhahn | |
| 3,367,732 | A | | 2/1968 | Beye | |
| 3,372,964 | A | | 3/1968 | Eversman | |
| 3,380,405 | A | | 4/1968 | Barecki et al. | |
| 3,544,186 | A | | 12/1970 | Bfirge | |
| 3,574,434 | A | | 4/1971 | Propst | |
| 3,635,174 | A | | 1/1972 | Ball et al. | |
| 3,643,604 | A | | 2/1972 | Jones et al. | |
| 3,687,505 | A | | 8/1972 | Fall et al. | |
| 3,698,754 | A | | 10/1972 | Means | |
| 3,700,301 | A | | 10/1972 | Boeck | |
| 3,722,964 | A | | 3/1973 | Chitester et al. | |
| 3,883,202 | A | | 5/1975 | Konig | |
| 3,909,093 | A | | 9/1975 | Lundberg | |
| 3,999,492 | A | | 12/1976 | Emrick | |
| 4,006,951 | A | | 2/1977 | Geer et al. | |
| 4,083,621 | A | | 4/1978 | Davidson et al. | |
| 4,110,552 | A | | 8/1978 | Lombardi | |
| 4,130,070 | A | | 12/1978 | Herrin | |
| 4,217,847 | A | | 8/1980 | McCloud | |
| 4,227,466 | A | | 10/1980 | Rooklyn | |
| 4,278,042 | A | | 7/1981 | Lindquist | |
| 4,290,232 | A | | 9/1981 | Shook | |
| 4,323,291 | A | | 4/1982 | Ball | |
| 4,372,223 | A | | 2/1983 | Iwatani | |
| 4,372,629 | A | | 2/1983 | Propst et al. | |
| 4,428,304 | A | | 1/1984 | Moser | |
| 4,433,630 | A | | 2/1984 | Laborie | |
| 4,452,439 | A | | 6/1984 | Hogan | |
| 4,453,486 | A | | 6/1984 | Harken | |
| 4,500,150 | A | | 2/1985 | Leibensperger | |
| 4,525,012 | A | | 6/1985 | Dunner | |
| 4,535,703 | A | | 8/1985 | Henriott et al. | |
| 4,610,487 | A | | 9/1986 | Delmege et al. | |
| 4,620,499 | A | | 11/1986 | Slemmons | |
| 4,632,248 | A | | 12/1986 | Hsu | |
| 4,635,763 | A | | 1/1987 | Omata | |
| 4,637,666 | A | * | 1/1987 | Worrell et al. | 108/143 |
| 4,654,756 | A | | 3/1987 | Wilson et al. | |
| 4,660,477 | A | | 4/1987 | Kortering et al. | |
| 4,660,493 | A | | 4/1987 | Lowry, III | |
| 4,679,950 | A | | 7/1987 | Delmege et al. | |
| 4,734,826 | A | | 3/1988 | Wilson et al. | |
| 4,739,129 | A | | 4/1988 | Owen et al. | |
| 4,751,884 | A | | 6/1988 | Ball | |
| 4,762,072 | A | | 8/1988 | Boundy et al. | |
| 4,766,422 | A | * | 8/1988 | Wolters et al. | 312/223.3 |
| 4,838,175 | A | * | 6/1989 | Hauville | 108/50.02 |
| 4,838,177 | A | | 6/1989 | Vander Park | |
| 4,852,500 | A | * | 8/1989 | Ryburg et al. | 108/50.01 |
| 4,867,701 | A | | 9/1989 | Wiand | |
| 4,875,418 | A | | 10/1989 | Moeckl et al. | |
| 4,879,955 | A | | 11/1989 | Moll et al. | |
| 4,884,513 | A | | 12/1989 | Newhouse et al. | |
| 4,948,205 | A | | 8/1990 | Kelley | |
| 4,956,897 | A | | 9/1990 | Speedie | |
| 4,971,576 | A | | 11/1990 | Thimmesch | |
| 4,974,912 | A | | 12/1990 | Rask et al. | |
| 4,974,913 | A | | 12/1990 | Vogt et al. | |
| 5,015,048 | A | | 5/1991 | Brunnert | |
| 5,024,167 | A | | 6/1991 | Hayward | |
| 5,048,698 | A | | 9/1991 | Konrad | |
| 5,078,461 | A | | 1/1992 | Beck et al. | |
| 5,083,512 | A | | 1/1992 | Newhouse et al. | |
| 5,103,741 | A | | 4/1992 | Grund et al. | |
| 5,106,043 | A | | 4/1992 | Solomon | |
| 5,115,105 | A | | 5/1992 | Gallusser et al. | |
| 5,121,698 | A | | 6/1992 | Kelley | |
| 5,130,494 | A | | 7/1992 | Simonton et al. | |
| 5,133,111 | A | | 7/1992 | Brown | |
| 5,143,432 | A | | 9/1992 | Ohshima et al. | |
| 5,154,126 | A | | 10/1992 | Newhouse et al. | |
| 5,168,124 | A | | 12/1992 | Takase et al. | |
| 5,181,620 | A | | 1/1993 | Watt | |
| 5,183,971 | A | | 2/1993 | Lafosse et al. | |
| 5,194,692 | A | | 3/1993 | Gallusser et al. | |
| 5,210,906 | A | | 5/1993 | Aihara et al. | |
| 5,228,357 | A | | 7/1993 | Dosaka | |
| 5,230,552 | A | | 7/1993 | Schipper et al. | |
| 5,231,562 | A | | 7/1993 | Pierce et al. | |
| 5,234,360 | A | | 8/1993 | Kramer, Jr. | |
| 5,236,374 | A | | 8/1993 | Leonard et al. | |
| 5,237,935 | A | | 8/1993 | Newhouse et al. | |
| 5,243,136 | A | | 9/1993 | Chen | |
| 5,302,016 | A | | 4/1994 | Lautenschlager | |
| 5,306,870 | A | | 4/1994 | Abat | |
| 5,319,356 | A | | 6/1994 | Yoshino | |
| 5,328,260 | A | | 7/1994 | Beirise | |
| 5,337,657 | A | | 8/1994 | Diffrient | |
| 5,363,774 | A | | 11/1994 | Anada et al. | |
| 5,368,490 | A | | 11/1994 | McKissick | |
| 5,386,636 | A | | 2/1995 | Asano | |
| 5,386,787 | A | | 2/1995 | Hall | |
| 5,394,658 | A | | 3/1995 | Schreiner et al. | |
| 5,421,646 | A | | 6/1995 | McNamara et al. | |
| 5,429,431 | A | | 7/1995 | Olson et al. | |
| 5,467,703 | A | | 11/1995 | Crinion | |
| 5,510,960 | A | | 4/1996 | Rosen | |
| 5,568,773 | A | * | 10/1996 | Hung | 108/50.02 |
| 5,647,652 | A | | 7/1997 | Zalewski et al. | |
| D383,726 | S | | 9/1997 | Nelson | |
| 5,666,888 | A | | 9/1997 | Dame et al. | |
| 5,680,820 | A | * | 10/1997 | Randolph | 108/25 |
| 5,697,686 | A | * | 12/1997 | Miller et al. | 108/143 |
| 5,711,517 | A | | 1/1998 | Kelly | |
| 5,718,178 | A | | 2/1998 | Smith | |
| 5,797,666 | A | * | 8/1998 | Park | 312/223.3 |
| 5,860,713 | A | | 1/1999 | Richardson | |
| 5,878,673 | A | * | 3/1999 | Kramer et al. | 108/50.02 |
| 5,894,805 | A | | 4/1999 | Raasch | |
| 5,902,148 | A | | 5/1999 | O'Rourke | |
| 5,906,420 | A | | 5/1999 | Rozier, Jr. et al. | |
| 5,912,807 | A | | 6/1999 | Gallagher, Sr. et al. | |
| 5,937,950 | A | | 8/1999 | Adams et al. | |
| 5,947,035 | A | | 9/1999 | Chang | |
| 5,954,525 | A | | 9/1999 | Siegal et al. | |
| 5,957,059 | A | | 9/1999 | Burhman | |
| 5,967,820 | A | | 10/1999 | Siegal et al. | |
| 5,971,341 | A | | 10/1999 | Pfister | |
| 6,003,447 | A | | 12/1999 | Cox et al. | |
| 6,003,716 | A | | 12/1999 | Allison et al. | |
| 6,038,985 | A | | 3/2000 | Chang | |
| 6,045,399 | A | | 4/2000 | Yu | |
| 6,085,667 | A | | 7/2000 | Gevaert et al. | |
| 6,086,397 | A | | 7/2000 | Chapman et al. | |
| 6,106,328 | A | | 8/2000 | O'Neal | |
| 6,162,071 | A | | 12/2000 | Muller | |
| 6,170,409 | B1 | | 1/2001 | Smith | |
| 6,176,561 | B1 | * | 1/2001 | Roels et al. | 108/50.02 |
| 6,180,884 | B1 | * | 1/2001 | Tokunaga et al. | 108/50.01 |
| 6,189,429 | B1 | | 2/2001 | Liu | |
| 6,202,567 | B1 | | 3/2001 | Funk et al. | |
| 6,202,568 | B1 | | 3/2001 | Kochanski et al. | |
| 6,206,206 | B1 | | 3/2001 | Saylor et al. | |
| 6,210,189 | B1 | | 4/2001 | Gantt | |
| 6,227,384 | B1 | | 5/2001 | Saylor et al. | |
| 6,250,729 | B1 | | 6/2001 | Allison et al. | |
| 6,254,206 | B1 | | 7/2001 | Petrick et al. | |
| 6,254,427 | B1 | | 7/2001 | Stathis | |
| 6,267,064 | B1 | * | 7/2001 | Ostertag et al. | 108/50.02 |
| 6,267,338 | B1 | | 7/2001 | Saylor et al. | |
| 6,327,983 | B1 | * | 12/2001 | Cronk et al. | 108/50.02 |
| 6,336,414 | B1 | | 1/2002 | Stewart et al. | |
| 6,338,301 | B1 | | 1/2002 | Almond | |
| 6,340,078 | B1 | | 1/2002 | Scheible | |
| 6,390,574 | B2 | | 5/2002 | Fraccaro | |
| 6,397,762 | B1 | | 6/2002 | Goldberg et al. | |

| | | | | |
|---|---|---|---|---|
| 6,415,723 | B1 | 7/2002 | Kopish et al. | |
| 6,427,608 | B1 | 8/2002 | Crinion | |
| 6,435,106 | B2 | 8/2002 | Funk et al. | |
| 6,435,461 | B1 | 8/2002 | Saylor et al. | |
| 6,457,422 | B1 | 10/2002 | Saul | |
| 6,486,407 | B1 | 11/2002 | Hawker et al. | |
| 6,488,248 | B1 | 12/2002 | Watt et al. | |
| 6,492,591 | B1 | 12/2002 | Metcalf | |
| 6,647,900 | B1 * | 11/2003 | Kopish | 108/50.02 |
| 6,675,722 | B2 | 1/2004 | Stathis et al. | |
| 6,712,433 | B2 * | 3/2004 | Hellwig et al. | 312/223.6 |
| 6,725,784 | B2 * | 4/2004 | Crinion | 108/50.02 |
| 6,750,410 | B2 | 6/2004 | Lee | |
| 6,769,747 | B2 | 8/2004 | Chan et al. | |
| 6,792,876 | B2 | 9/2004 | Lin | |
| 6,799,523 | B1 | 10/2004 | Cunha | |
| 6,805,579 | B2 | 10/2004 | Marchand et al. | |
| 6,814,244 | B1 | 11/2004 | Hathcock | |
| 6,835,891 | B1 | 12/2004 | Herzog et al. | |
| 6,857,381 | B2 | 2/2005 | Siewert et al. | |
| 6,857,712 | B1 | 2/2005 | Haberman | |
| RE38,709 | E | 3/2005 | Gutgsell et al. | |
| 7,007,614 | B2 | 3/2006 | Gaunt et al. | |
| 7,028,370 | B2 | 4/2006 | Hoshide et al. | |
| 7,057,108 | B1 | 6/2006 | Sodemann et al. | |
| 7,063,574 | B2 | 6/2006 | Mazzullo et al. | |
| 7,064,275 | B2 | 6/2006 | Henriott et al. | |
| 7,066,097 | B2 | 6/2006 | Gayhart et al. | |
| 7,191,713 | B2 | 3/2007 | Gayhart et al. | |
| 7,258,317 | B1 | 8/2007 | Nagel | |
| 7,278,360 | B2 | 10/2007 | Griepentrog | |
| 7,287,304 | B2 | 10/2007 | Zebe, Jr. | |
| 7,343,864 | B2 | 3/2008 | Canin et al. | |
| 7,748,328 | B2 * | 7/2010 | Horton | 108/50.01 |
| 2002/0189848 | A1 | 12/2002 | Hawker et al. | |
| 2004/0017138 | A1 | 1/2004 | Mueller et al. | |
| 2004/0103829 | A1 | 6/2004 | Oakes | |
| 2004/0256135 | A1 | 12/2004 | Liu | |
| 2005/0263041 | A1 * | 12/2005 | Mueller et al. | 108/50.02 |
| 2005/0268823 | A1 * | 12/2005 | Bakker et al. | 108/50.02 |
| 2005/0279257 | A1 * | 12/2005 | Bettinger | 108/50.02 |
| 2006/0042520 | A1 | 3/2006 | Stevens et al. | |
| 2006/0065162 | A1 | 3/2006 | Chi et al. | |
| 2006/0065167 | A1 | 3/2006 | Chi et al. | |
| 2006/0096506 | A1 | 5/2006 | Brauning et al. | |
| 2006/0162626 | A1 | 7/2006 | Brauning et al. | |
| 2007/0012823 | A1 | 1/2007 | Hubbard | |
| 2008/0035030 | A1 * | 2/2008 | Horton | 108/50.02 |
| 2008/0035031 | A1 * | 2/2008 | Yamanishi et al. | 108/50.02 |
| 2008/0035034 | A1 | 2/2008 | Morita et al. | |
| 2008/0224582 | A1 | 9/2008 | Boland | |
| 2008/0295745 | A1 * | 12/2008 | Hamilton et al. | 108/50.02 |
| 2009/0273260 | A1 * | 11/2009 | Kemp | 312/223.3 |
| 2010/0024688 | A1 * | 2/2010 | Kitada et al. | 108/50.02 |

FOREIGN PATENT DOCUMENTS

| | | | |
|---|---|---|---|
| KR | 20070101968 | | 10/2007 |
| WO | 2006128218 | A1 | 12/2006 |

* cited by examiner

WORKSURFACE ASSEMBLY

CROSS-REFERENCE TO RELATED APPLICATIONS

The present application claims the benefit of U.S. Provisional Application No. 61/056,739, entitled WORKSURFACE ASSEMBLY, filed on May 28, 2008, the entire contents of which are incorporated herein by reference.

BACKGROUND OF THE INVENTION

Various types of desks and other worksurfaces have been developed for use in offices and other such environments. Various types of powered equipment may be utilized in connection with a worksurface in a modern office environment. Also, phones, modems, and other such devices may require the use of data lines. Efforts have been made to develop worksurfaces providing for power and data routing. Efforts have also been made to accommodate handling and organization of documents and other items.

SUMMARY OF THE INVENTION

One aspect of the present invention is a worksurface assembly including a support structure and a power supply system having at least one power supply receptacle. The worksurface assembly also includes a worksurface member that is movably connected to the support structure for movement between extended and retracted positions relative to the support structure. The worksurface member substantially prevents access to the power supply receptacle when in the retracted position, and permits access to the power supply receptacle when the worksurface member is in the extended position. The worksurface member moves in a first direction from the extended position to the retracted position, and moves in a second direction from the retracted position to the extended position. The worksurface member defines an enlarged upwardly-facing upper surface. The worksurface assembly also includes a movement control device that permits movement of the worksurface member in the first direction such that the worksurface member can be moved from the extended position to the retracted position. The movement control device selectively restricts movement of the worksurface member in the second direction to thereby retain the worksurface member in the retracted position.

Another aspect of the present invention is a worksurface system including a support structure configured to support the worksurface system on a floor surface or a partition structure. The worksurface system also includes a worksurface member defining a front portion, a rear portion, opposite end portions, and a horizontally enlarged upper surface. An elongated rail member having an upwardly-opening slot extends along at least a portion of the rear portion of the worksurface member. The elongated rail member has a horizontally-facing side surface, and an upwardly-facing upper surface. An accessory unit is supported on the rail member. The accessory unit includes at least one upright support structure having a connecting structure at a lower end thereof. The connecting structure includes an extension received in the slot of the elongated rail member, a first surface contacting the upwardly-facing side surface of the elongated rail member, and a second surface facing the extension and contacting the horizontally-facing side surface of the elongated rail member.

BRIEF DESCRIPTION OF THE DRAWINGS

FIG. 6 showing a locking or latching mechanism for the movable worksurface top member and a power trough and rail;

FIG. 2;

FIG. 12

DETAILED DESCRIPTION OF PREFERRED EMBODIMENT

Figure 1:
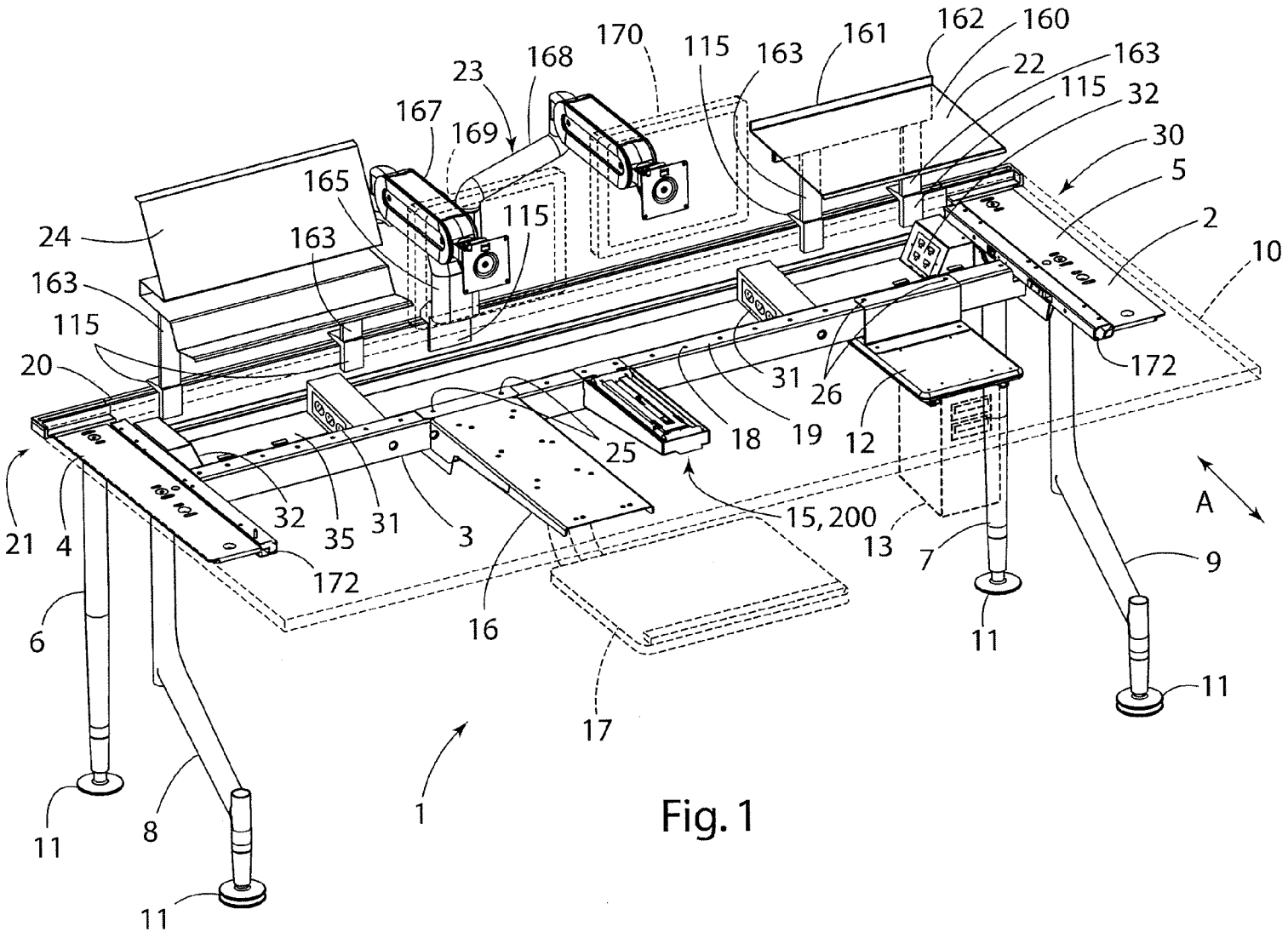
FIG. 1 is an isometric view of a worksurface assembly according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a worksurface assembly 1 according to the present invention includes a frame structure 2 and a worksurface top member 10 that is movably mounted to the frame structure for back and forth movement in the direction indicated by arrow "A". As discussed in more detail below, a latch or locking mechanism 15 provides for controlled movement of worksurface top 10 relative to frame structure 2. Rear legs 6 and 7 and front legs 8 and 9 extend downwardly from frame structure 2 and provide support for worksurface assembly 1. Adjustable glides 11 mounted to lower ends of legs 6-9 may be utilized to account for irregularities in a support surface such as a floor. As also described in more detail below, a rail 20 extends along a rear portion 21 of worksurface assembly 1, and provides for mounting of various accessory units such as a shelf 22, a dual monitor support arm unit 23, and an angled document support unit 24. Worksurface assembly 1 also includes a power and data supply system 30 including a utility trough 35 and a plurality of power receptacles 31 and data receptacles 32 that can be accessed when worksurface top member 10 is moved to the open position.

Figures 7, 8, 9, 10, 11:
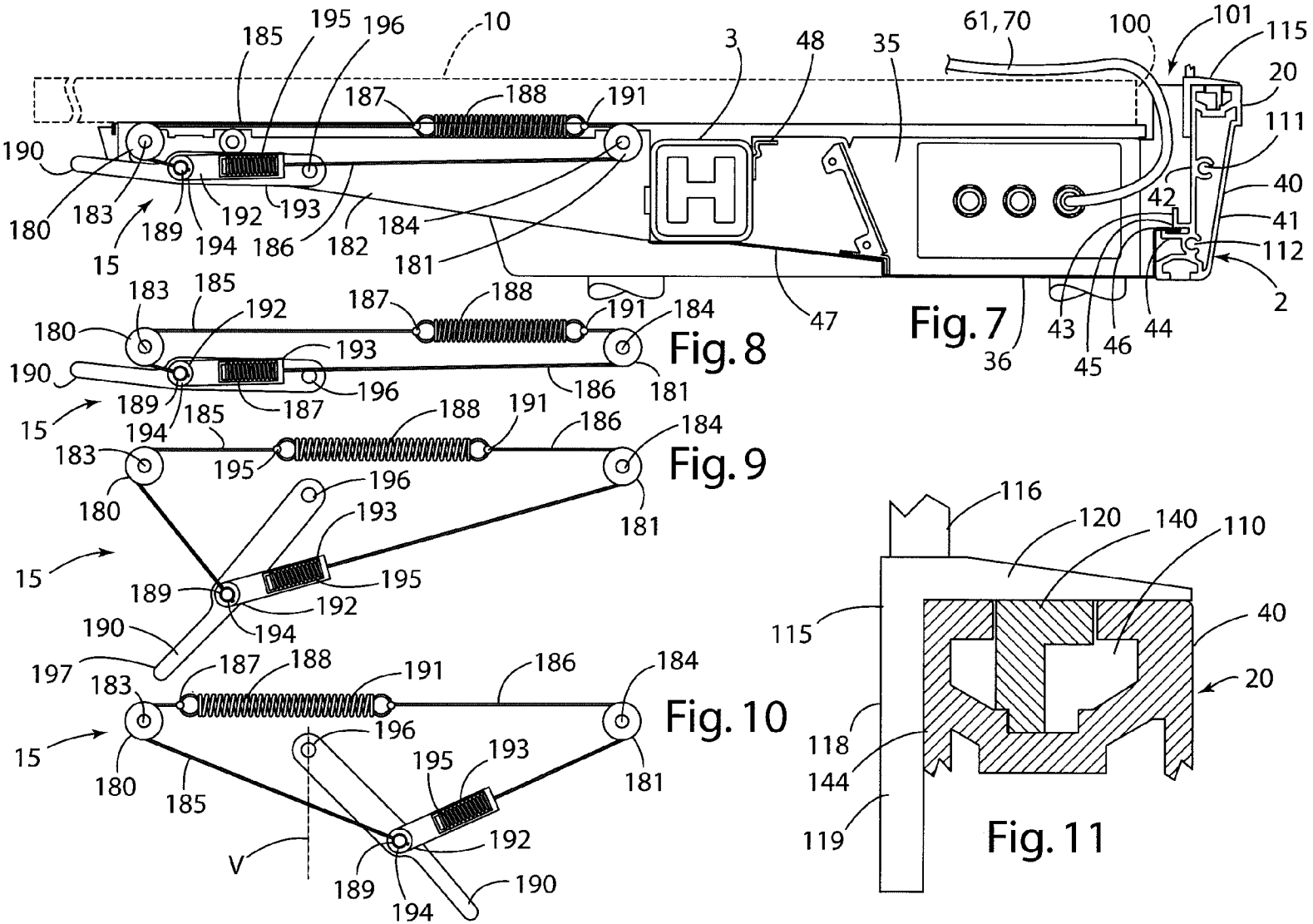
FIG. 7 is a cross-sectional view taken along the line VII-VII.
FIG. 8 is a partially schematic view of the latching or lock mechanism of FIG. 7 when the worksurface top member is in a closed position.
FIG. 9 is a partially schematic view of the latching or lock mechanism of FIG. 7 when the worksurface top member is in an intermediate position.
FIG. 10 is a partially schematic view of the latching or lock mechanism of FIG. 7 when the worksurface top member is in a fully open position.
FIG. 11 is a fragmentary cross-sectional view of the support rail and an accessory unit taken along the line XI-XI.
Figure 12:
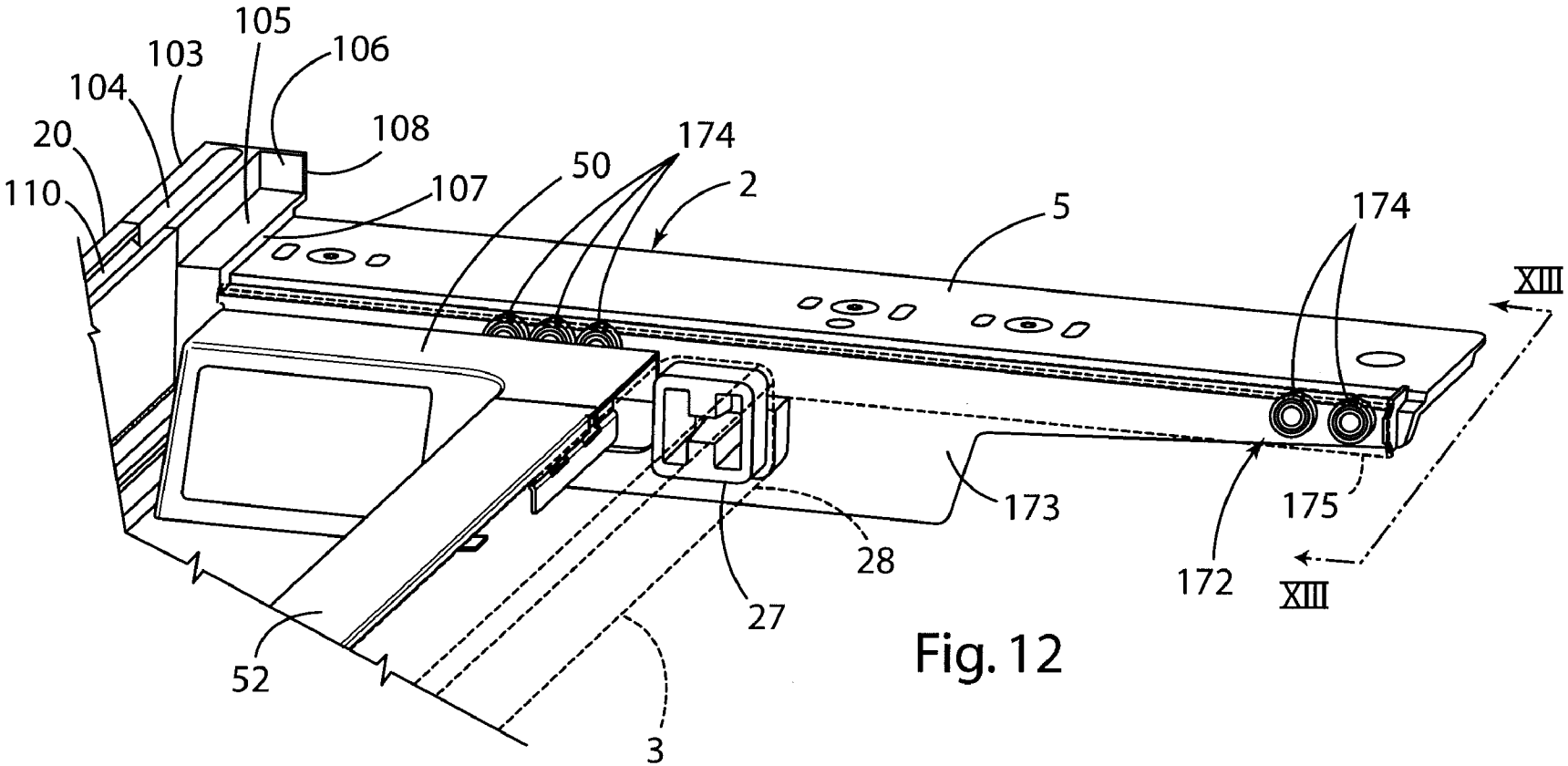
FIG. 12 is a fragmentary, isometric view of a portion of the worksurface assembly of FIG. 1.

Frame 2 includes end bracket structures 4 and 5, a tubular cross member 3 and rail 20. Tubular cross member 3 and rail 20 extend between end bracket structures 4 and 5 and interconnect end bracket structures 4 and 5 to provide a rigid support structure. Referring to FIG. 7, extrusion 40 may include screw-receiving portions 111 and 112 that receive threaded fasteners (not shown) to thereby rigidly interconnect extrusion 40 with end bracket structures 4 and 5. With reference to FIG. 12, end bracket structures 4 and 5 may include a raised boss 27 that is received in open end 28 of cross member 3. Threaded fasteners or the like (not shown) may be utilized to interconnect bracket structures 4, 5 to cross member 3 and rail 20. Bracket structures 4 and 5 may be formed of cast aluminum or other suitable material or processes. Cross member 3 may comprise a tubular steel or aluminum member or other suitable structure/material. Legs 6-9 are rigidly connected to end bracket structures 4 and 5 via conventional threaded fasteners or other suitable connectors. An optional computer support 12 may be secured to the cross member 3 to support a computer 13 in a hanging manner below top 10. A keyboard support structure 16 may also be secured to cross member 3 to provide for mounting of a keyboard support platform 17. In the illustrated example, keyboard support structure 16 is configured to mount any one of a number of commercially available support platforms 17 utilizing a known mounting interface. In this way, keyboard structure 16 provides for mounting of a selected keyboard support platform 17 as required for a particular application. A plurality of openings 18 in cross member 13 are positioned at equally-spaced intervals along upper surface 19 of cross-member 3. During assembly, openings 25 in keyboard support structure 16 and openings 26 in computer support 12 are aligned with selected ones of openings 18, and convention threaded fasteners or the like (not shown) are received in openings 18, 25 and 26 to thereby secure computer supports 12 and keyboard support 16 to cross-member 3. Openings 18 thereby provide for mounting of keyboard support structure 16 and computer support 12 at a selected side-to-side position along cross member 3 as required for a particular application.

Figure 2:
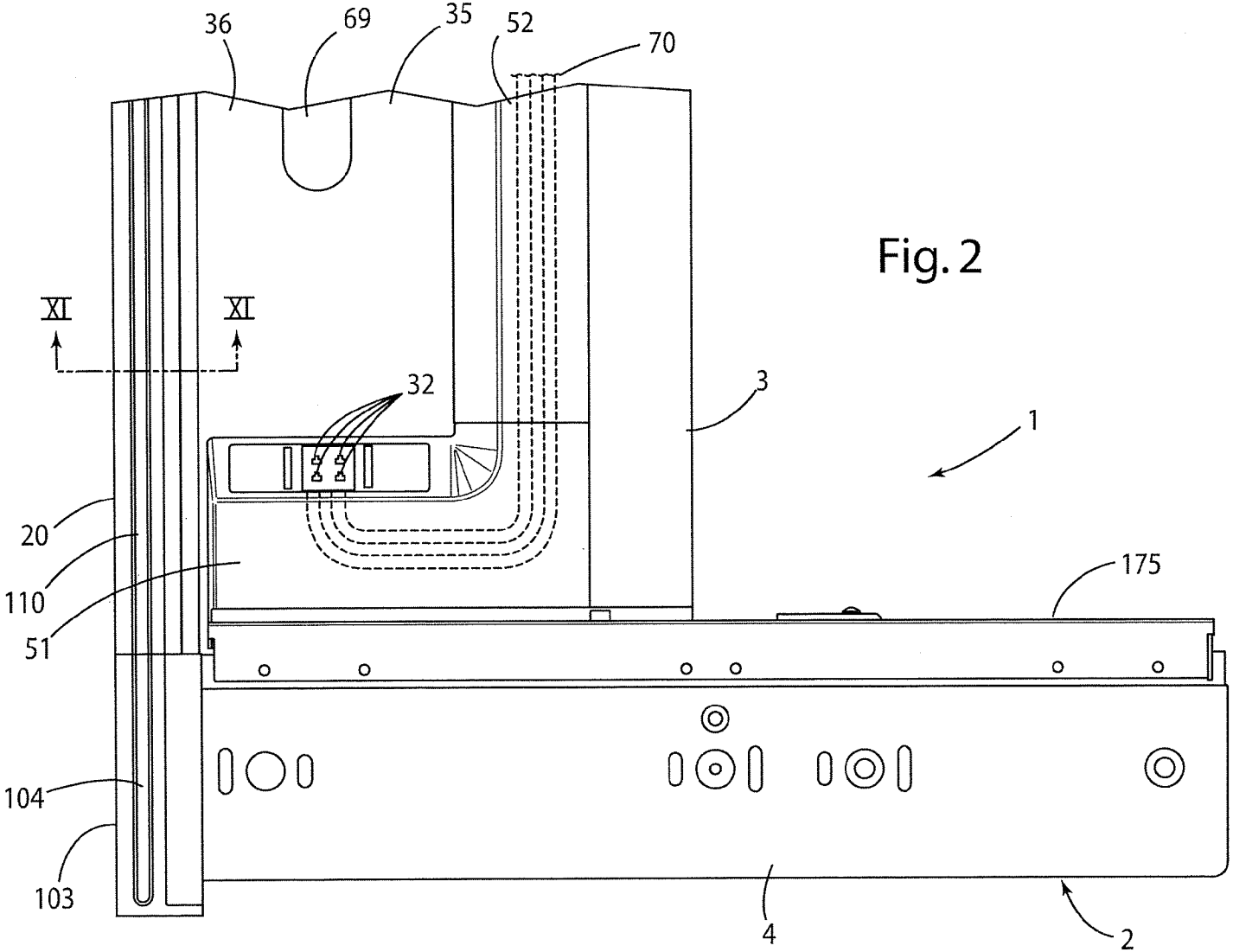
FIG. 2 is a fragmentary, top plan view of a portion of the worksurface assembly of FIG. 1.
Figure 3:
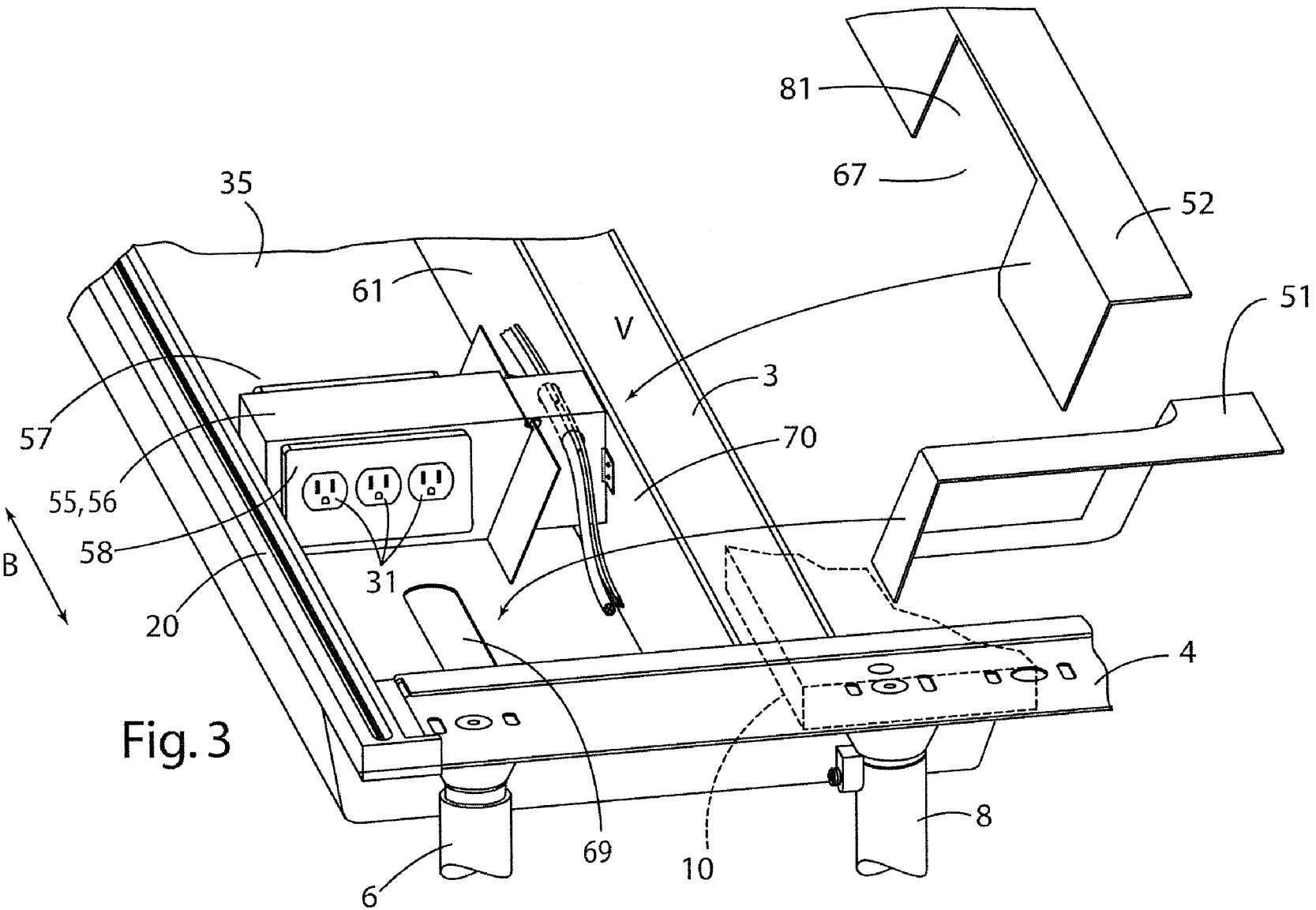
FIG. 3 is a fragmentary isometric of a portion of the worksurface assembly of FIG. 1 with the worksurface top member in an open position.
Figure 4:
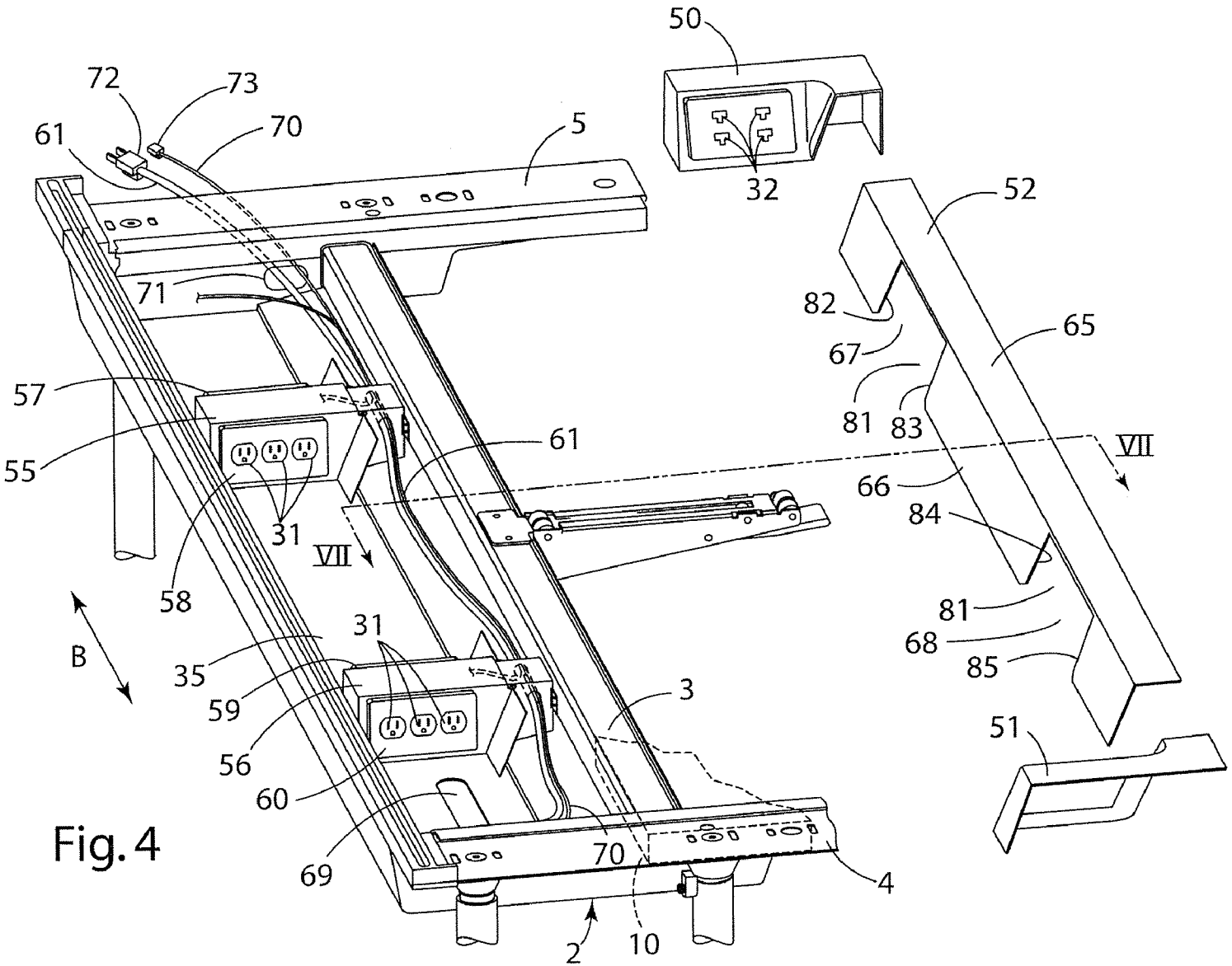
FIG. 4 is a fragmentary isometric of a portion of the worksurface assembly of FIG. 1.

With further reference to FIGS. 2-4, utility trough 35 is generally U-shaped, and opens upwardly to provide for access to power receptacles 31 and data receptacles 32 when worksurface top 10 is in the open position. With further reference to FIG. 7, utility trough 35 is formed, in part, by a trough member 36 that is connected to cross member 3 and rail 20. In the illustrated example, rail 20 comprises an extrusion member 40 made of aluminum or the like. Extrusion 40 includes a rear wall 41 and a front wall 42. First and second flanges or lips 43 and 44 project forwardly from front wall 42, and form a groove 45 therebetween that receives a rearwardly-projecting flange 46 of utility trough member 36 to thereby support the utility trough member 36. A bracket 48 connects a front portion 47 of utility trough member 36 to cross-member 3 to thereby support front portion 47 of utility trough member 36. In the illustrated example, utility trough member 36 is made of a sheet metal. Other suitable materials may, however, be utilized.

Referring again to FIGS. 2-4, worksurface assembly 1 includes an electrical power supply system including power blocks 55 and 56 that are secured to cross-member 3, and extend into utility trough 35. A plurality of power receptacles 31 are mounted on opposite side faces 57 and 58 of power block 55, and opposite faces 59 and 60 of power block 56. Power lines 61 can be routed adjacent cross-member 3 to provide power to power blocks 55 and 56. Removable end covers 50 and 51, and a removable central cover 52 cover power lines 61 when installed. As discussed in more detail below in connection with FIGS. 5 and 5A, power blocks 55 and 56 (or 55A) are connected to cross-member 3, and the position of power blocks 55 and 56 can be adjusted in a direction of arrow "B" (FIGS. 4 and 5A) as required for a particular application.

Phone or data lines 70 can be routed from data receptacles 32. Removable end covers 50 and 51 are utilized to cover data lines 70 adjacent data receptacles 32, and cover 52 may be utilized to cover data lines 70 extending along cross-member 3. End bracket structures 4 and 5 include openings 71, and power lines 61 and data lines 70 can be routed through opening 71. In the illustrated example, a conventional power plug connector 72 is provided at the end of power line 61, and a conventional connector 73 is provided at the end of data line 70. The power and/or data lines may also be routed through openings 69 in utility trough 35. However, other power and/or data connecting arrangements may also be utilized to connect the power and data lines to the power and phone lines in a building structure or the like.

Figure 5:
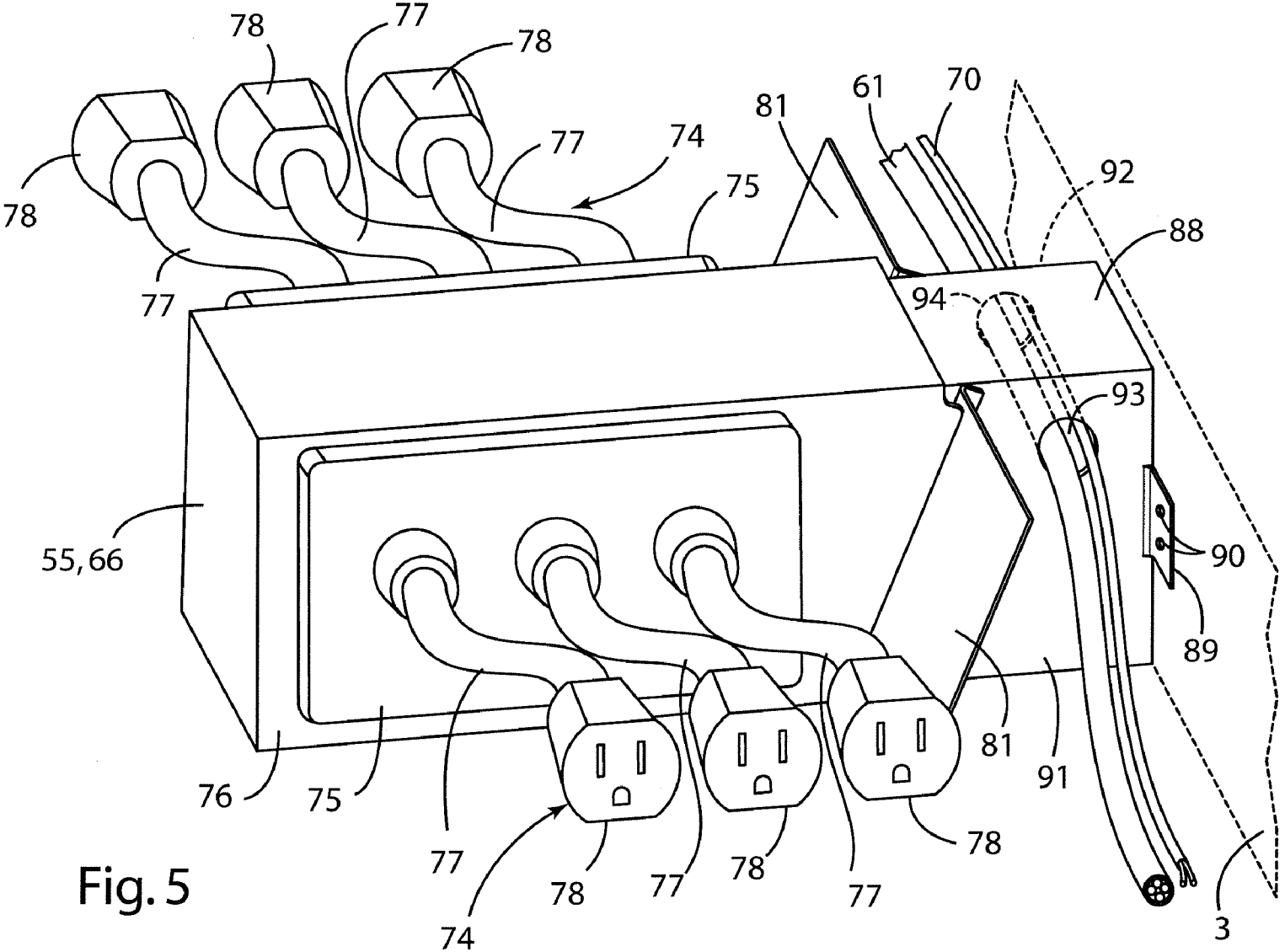
FIG. 5 is an isometric view of a component that may be utilized in the worksurface assembly of FIG. 1 to provide electric power.

With further reference to FIG. 5, multi-cord power supply assemblies 74 may be connected to power block 55 and/or power block 56. In the illustrated example, multi-cord power supplies 74 include a base plate 75 that connects to side 76 of power block 55, 56, and a plurality of insulated power lines 77 extend from base plates 75. Plug receptacles 78 provide for connection to standard power plugs to thereby supply power to various electrical devices used in connection with worksurface assembly 1.

Power blocks 55 and 56 include transverse flaps 81 (see also FIG. 5) that extend outwardly away from opposite sides 76. When assembled, flaps 81 extend behind sidewall 66 (see also FIG. 4) of cover 52 at edges 82 and 83 of cut out 67, and edges 84 and 85 of cut out 68. An end portion 88 of power blocks 55 and 56 is positioned below cover 52 when assembled, and includes tabs 89 having openings 90 that receive conventional threaded fasteners or the like to thereby secure power blocks 55 and 56 to cross-member 3. Tabs 89 thereby form brackets 62 and 63 (FIG. 4) to permit mounting of power blocks 55 and 56 at a selected position along utility trough 35 as indicated by arrow "B" (FIGS. 3 and 4). End portion 88 may be constructed from a relatively thin metal material or other suitable material, and includes opposite sidewalls 91 and 92. Openings 93 and 94 through sidewalls 91 and 92, respectively, provide for routing of power lines 61 and data or phone lines 70 along cross member 3. Referring again to FIGS. 3 and 4, cover 52 includes a horizontal top wall 65 and an upright sidewall 66. Cut outs 67 and 68 provide clearance for connecting power blocks 55 and 56 to cross-member 3. Cover 52 may be made of a relatively thin material, such that cutouts 67 and 68 may be manually formed during installation of power blocks 55 and 56 to thereby provide for positioning of the power blocks at the time worksurface assembly 1 is installed in an office environment or the like.

Figure 5A:
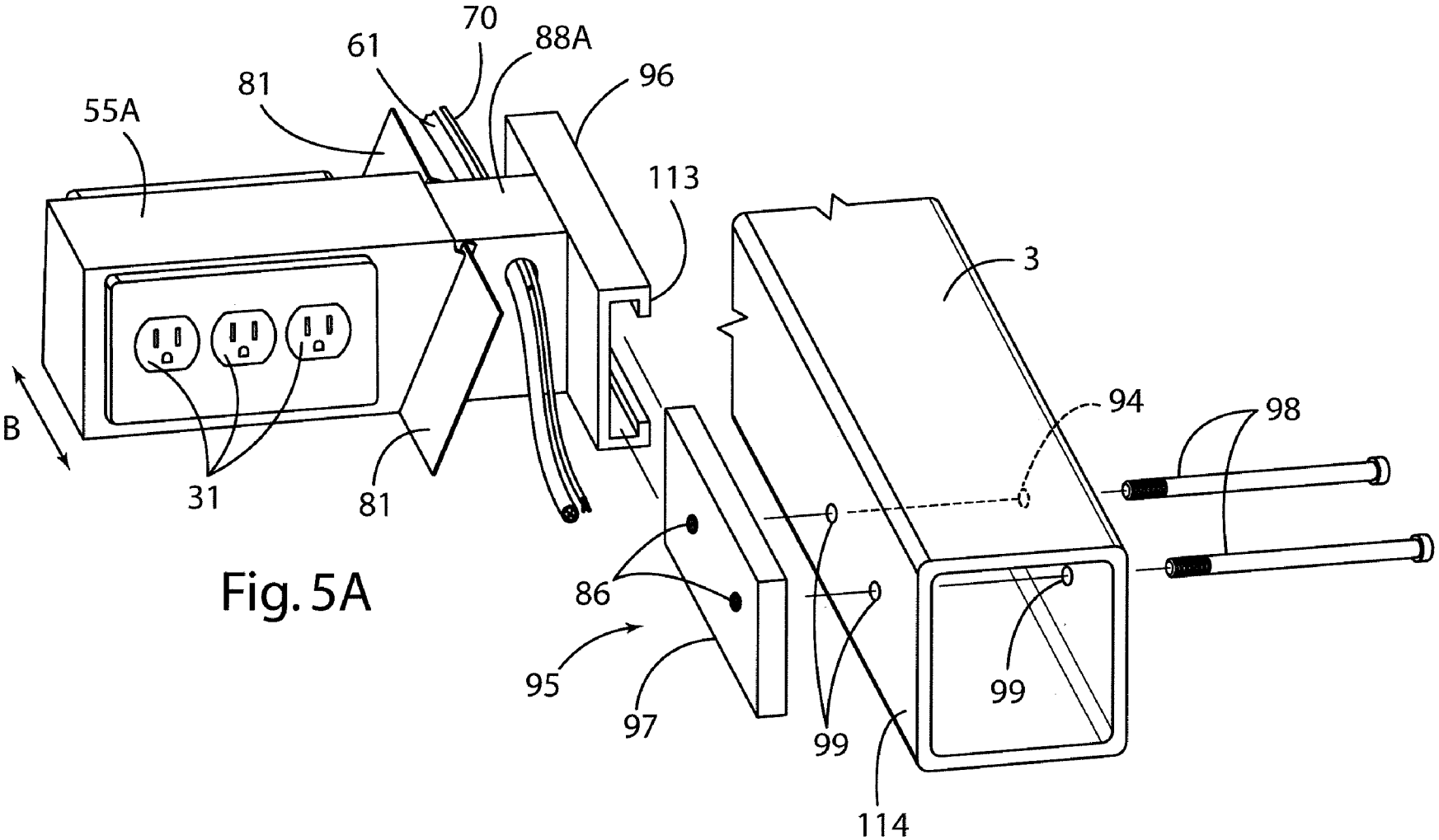
FIG. 5A is an isometric view of another component according to another aspect of the present invention that may be utilized in the worksurface assembly of FIG. 1 to provide electric power.

With further reference to FIG. 5A, a power block 55A according to another aspect of the present invention includes an adjustable mounting arrangement 95 comprising a C-channel 96 mounted on end portion 88A of power block 55A. Threaded fasteners 98 extend through clearance openings 99 in cross member 3, and threadably engage threaded openings 86 in plate 97. The position of power block 58 can be adjusted in the direction of arrow "B" by sliding C-channel 96 along plate 97 with threaded fasteners 98 initially in a relatively loose state. Threaded fasteners 98 can then be tightened, and surfaces 113 of C-channel 96 bear against outer surface 114 of cross member 3 to thereby fix the position of power block 55A.

Figure 6:
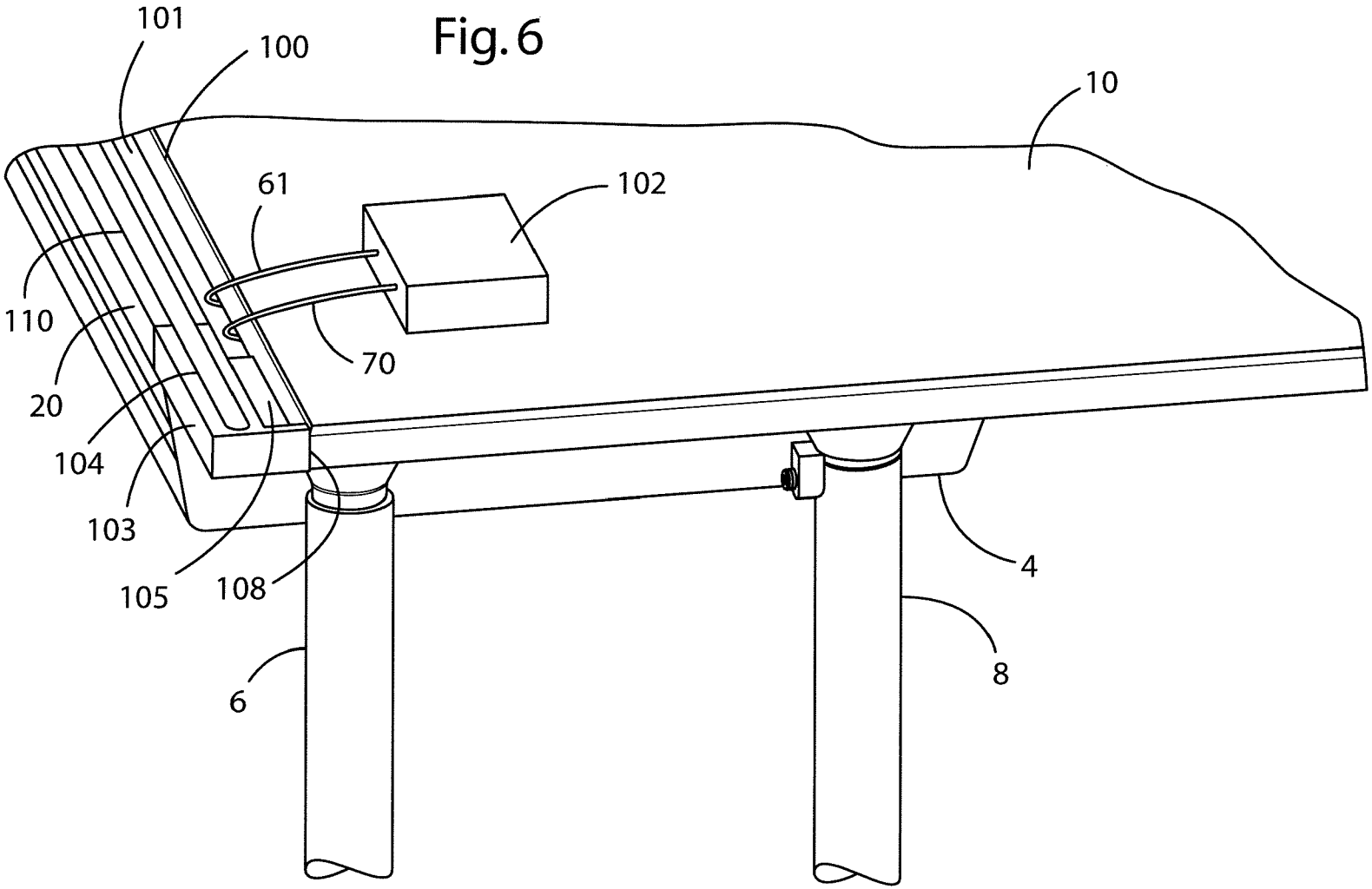
FIG. 6 is a fragmentary isometric view of a portion of the worksurface of FIG. 1 with the worksurface top member in a closed position.

With reference to FIG. 6, when worksurface top 10 is in the closed position, rear edge surface 100 of top 10 is spaced-apart from rail 20 to form a gap 101 between rail 20 and rear edge surface 100. Power and/or data lines 61 and 70, respectively can be routed from within utility trough 35 through gap 101 to thereby supply power for various devices 102 positioned on worksurface top 10, or to devices positioned adjacent the worksurface top. With further reference to FIGS. 2 and 12, end bracket structures 4 and 5 include a portion 103 having an upwardly opening slot 104 that aligns with a slot 110 in rail 20. Portion 103 of end bracket structures 4 and 5 also includes a base portion 105, and a side portion 106 that extend towards rear edge surface 100 of worksurface top 10 to form edge surfaces 107 and 108, respectively. When worksurface top 10 is in the closed position, portions of rear edge surface 100 of worksurface top 10 may abut or contact edge surfaces 107 and 108 such that the rear edge surface of the worksurface top is spaced-apart from rail 20 to form gap 101. As discussed in more detail below, mechanism 15 (FIG. 1) also limits rearward travel of worksurface top 10. Accordingly, in use, rear edge surface 100 of worksurface top 10 may not always contact edge surfaces 107 and 108 (FIG. 12) of end bracket structures 4 and 5, and the rear edge surface may actually be spaced-apart from edge surfaces 107 and 108 slightly under some circumstances. When top 10 is in the open position (FIG. 3), power lines can be connected to power receptacles 31 and/or plugs 78 (FIG. 5), and phone/data lines can be connected to data receptacles 32, and routed along utility trough 35 as required. Top 10 is then closed, and power and/or data lines 61 and 70, respectively, can be routed through gap 101 (FIG. 6).

Figure 11A:
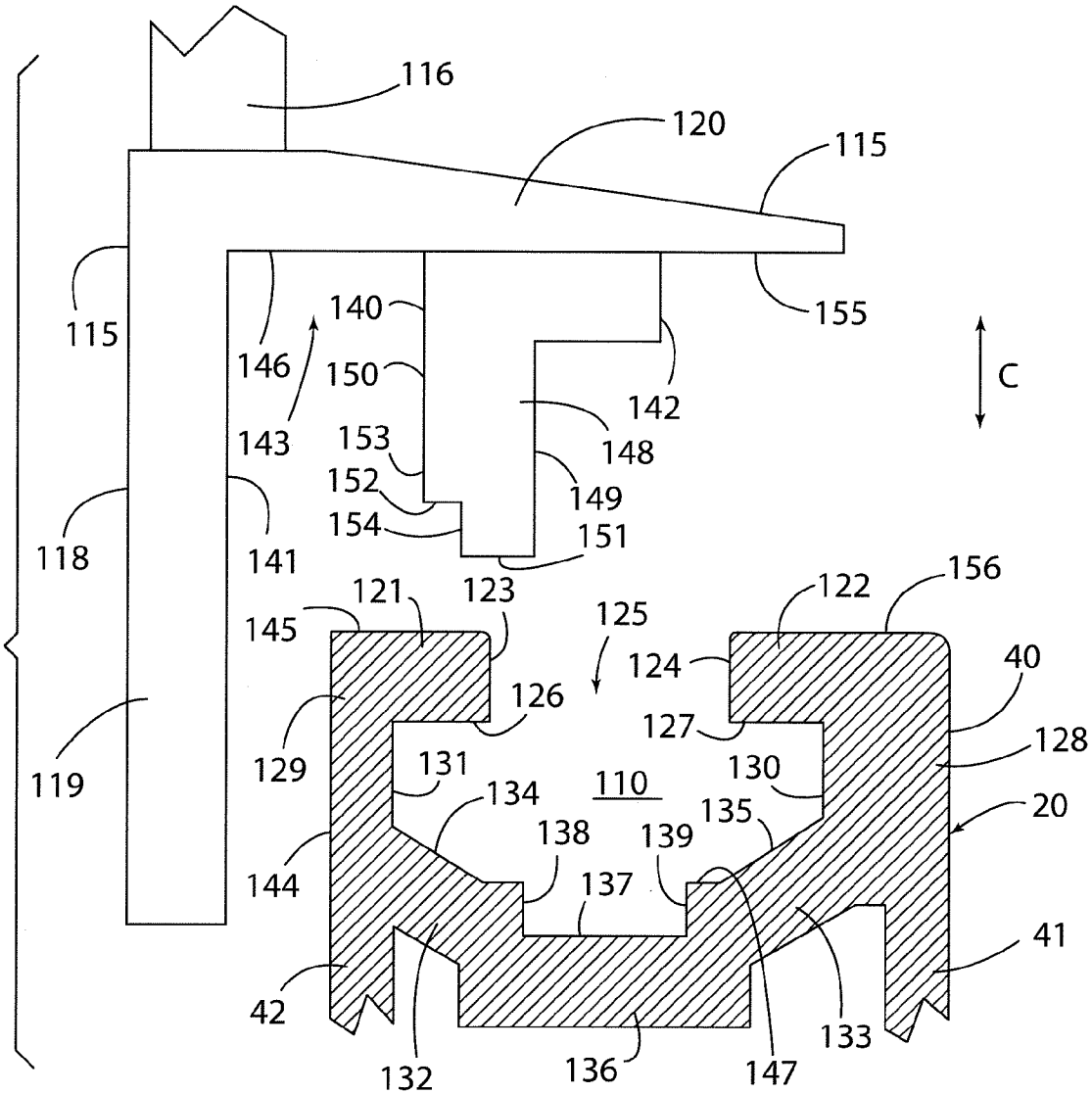
FIG. 11A is a fragmentary, exploded view of a portion of the rail and connecting structure of an accessory unit.

Referring again to FIG. 1, one or more accessories such as shelf 22, monitor support arm unit 23, and document support unit 24 may be secured to rail 20. Each of the accessories includes connecting structure 115 that secures accessory units 22, 23, and 24 to rail 20. With further reference to FIGS. 11 and 11A, upwardly extending structure 116 of accessories 22, 23, and 24 is rigidly connected to connecting structure 115. Connecting structure 115 includes an L-shaped portion 118 including a vertical leg 119 and a horizontal leg 120. In the illustrated example, legs 119 and 120 are relatively flat flange or tab-like members.

Extrusion 40 includes inwardly-extending flange portions 121 and 122 (FIG. 11A) defining inner surfaces 123 and 124, respectively, that together define an opening 125 of slot 110. Flange portions 121 and 122 form inwardly-facing lower surfaces 126 and 127, respectively, and upper portions 128 and 129 of rear wall 41 and front wall 42, respectively, form inwardly-facing surfaces 130 and 131. Angled wall portions 132 and 133 extend inwardly from front wall 42 and rear wall 41, respectively, and define angled upper surfaces 134 and 135. A horizontal base wall portion 136 extends between angled wall portions 132 and 134, to define an upwardly-facing base surface 137 and vertical side surfaces 138 and 139.

Connecting structure 115 includes an extension 140 that extends downwardly from horizontal leg 120 of connecting structure 115. Inwardly-facing surface 141 of vertical leg 119 is spaced-apart from vertical surface 142 formed by extension 140 to define a space 143. When assembled (FIG. 11) outer surface 144 of front wall 42 of extrusion 40 is closely received against inwardly facing surface 141 of vertical leg 119, and inner surface 123 of inwardly extending flange portion 121 of extrusion 40 is closely received against or adjacent vertical surface 142 of extension 140, and a downwardly-facing surface 146 of horizontal leg 120 of L-shaped portion 118 abuts an upwardly-facing surface 145 of inwardly-extending flange portion 121 of extrusion 40.

An end portion 148 of extension 140 includes first and second opposite side surfaces 149 and 150, and an end surface 151. A notch 152 is formed by orthogonal surfaces 153 and 154 formed in end portion 148. When assembled (FIG. 11), end surface 151 of end portion 148 of extension 140 abuts upwardly facing base surface 137 of extrusion 40, surface 154 of notch 152 abuts vertical side surface 139 of extrusion 40, and surface 153 of notch 152 is spaced apart from a small distance a surface 147 of extrusion 40. Also, lower surface 155 of horizontal leg 120 of L-shaped portion 118 of connecting structure 115 abuts upper 156 of inwardly-extending flange portion 122 of extrusion 40, and surface 142 of extension 140 abuts surface 123 of extrusion 40. Surface 150 of extension 140 is positioned closely adjacent, or in contact with, surface 124 of extrusion 40. It will be understood that connecting structure 115 and extrusion 40 may be configured somewhat differently such that not all of these surfaces actually simultaneously abut or contact one another. For example, surface 151 of extension 141 may, in use, be spaced apart from surface 137 of extrusion 40, and contact between lower surfaces 146 and 155 of horizontal leg 120 and upwardly-facing surfaces 145 and 156 of extrusion 40 may provide the primary vertical support for connecting structure 115 when mounted to rail 20. Contact between surface 141 of leg 119 and surface 144 of extrusion 40 and/or contact between surfaces 142 and 150 of extension 140 and surfaces 123 and 124 of extrusion 40 may provide the primary horizontal locating features.

Figure 11B:
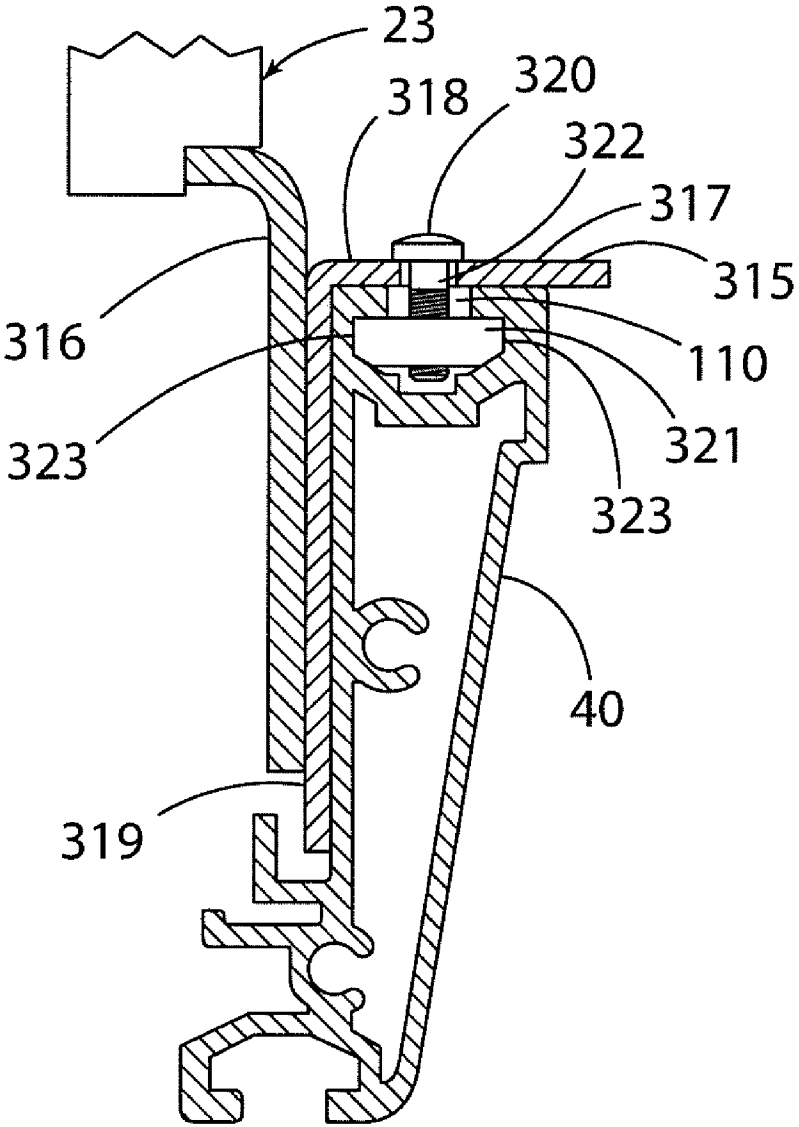
FIG. 11B is a fragmentary cross-sectional view of the support rail and an accessory unit mounting arrangement according to another aspect of the present invention.

With further reference to FIG. 11B, accessory units 22, 23, and 24 may include a mounting structure or device 315 instead of a connecting structure 115. In the illustrated example, monitor support arm unit 23 comprises a mounting structure 315, a bracket 317 having a horizontal arm or web 318, and a vertical arm or web 319 that is connected to an upwardly extending structure 316. A threaded fastener 320 extends through an opening 322 in horizontal arm 318, and threadably engages an anchor or nut 321 disposed in slot 110. In the illustrated example, nut 321 includes opposite side surfaces 323 that engage opposite surfaces 130 and 131 of slot 110 to prevent rotation of anchor 321 relative to extrusion 40 upon tightening of threaded fastener 320. When threaded fastener 320 is loose, it can be slid along slot 110 to change the position of mounting structure 315 and accessory unit 23. When threaded fastener 320 is tightened, anchor 321 bears against surfaces 126 and 127 of slot 110. In this way, mounting structure 315 provides a clamp to securely fasten monitor support arm unit 23 to rail 20.

To install or remove an accessory 22, 23, or 24 from rail 20, connecting structure 115 is shifted vertically relative to rail 20 in the direction of arrow "C" (FIG. 11A). When connecting structure 115 is fully engaged with slot 110 of rail 20 as shown in FIG. 11, gravitational forces tend to maintain engagement between connecting structure 115 and rail 20, and the configuration of connecting structure 115 and extrusion 40 provide a secure, moment-resisting connection that retains accessories 22, 23, and/or 24 in an upright position. The position of accessories 22, 23, and 24 may be adjusted by sliding the accessory along rail 20. If required, the accessory may be raised slightly to disengage connecting structure 115 from rail 20 to permit such adjustment. If a clamp-type mounting structure 315 (FIG. 11B) is included in the accessory unit, threaded fastener 320 may be tightened and/or loosened as required to permit adjustment of the position of monitor support arms 23 on extrusion 40 of rail 20.

In the illustrated example, the accessory units include a shelf 22 (FIG. 1) having a horizontal surface 160 and a raised portion 161 extending along a rear edge 162 of horizontal surface 160. A pair of structural uprights 163 extend from horizontal surface 160 and connecting structures 115 are disposed at the lower ends of extensions 163. The length of extensions 163 may vary as required to provide a desired height for horizontal surface 160. Similarly, the size of horizontal surface 160 may be selected to meet the needs of a particular application. A plurality of shelves 22 having different sizes and/or heights may be fabricated, and a shelf having a specific size and/or height may be selected as required for a particular application. Similarly, an angled document holder or support 24 includes a pair of extensions 163 with connecting structure 115 to provide for mounting of documents 424 to rail 20 at a selected position. Dual monitor arm support 23 includes a base portion 165 having a mounting structure 115 that provides for mounting of monitor support arm unit 23 to rail 20. In the illustrated example, mounting structure 115 of monitor support arm unit 23 is somewhat wider than connecting structures 115 of shelf 22 and document support 24 to provide for stable mounting of monitor support arm unit 23 utilizing a single connecting structure 115. Connecting structure 115 of monitor support arm unit 23 has substantially the same cross sectional configuration as shown in FIGS. 11 and 11A. In the illustrated example, dual monitor support arm unit 23 includes a first arm 167, and a second arm 168 extending from a single base portion 165 to support first and second monitors or display screens 169 and 170. Arms 167 and 168 are configured to articulate according to a known design to provide for adjustment of the positions of screens 169 and 170.

Figure 13:
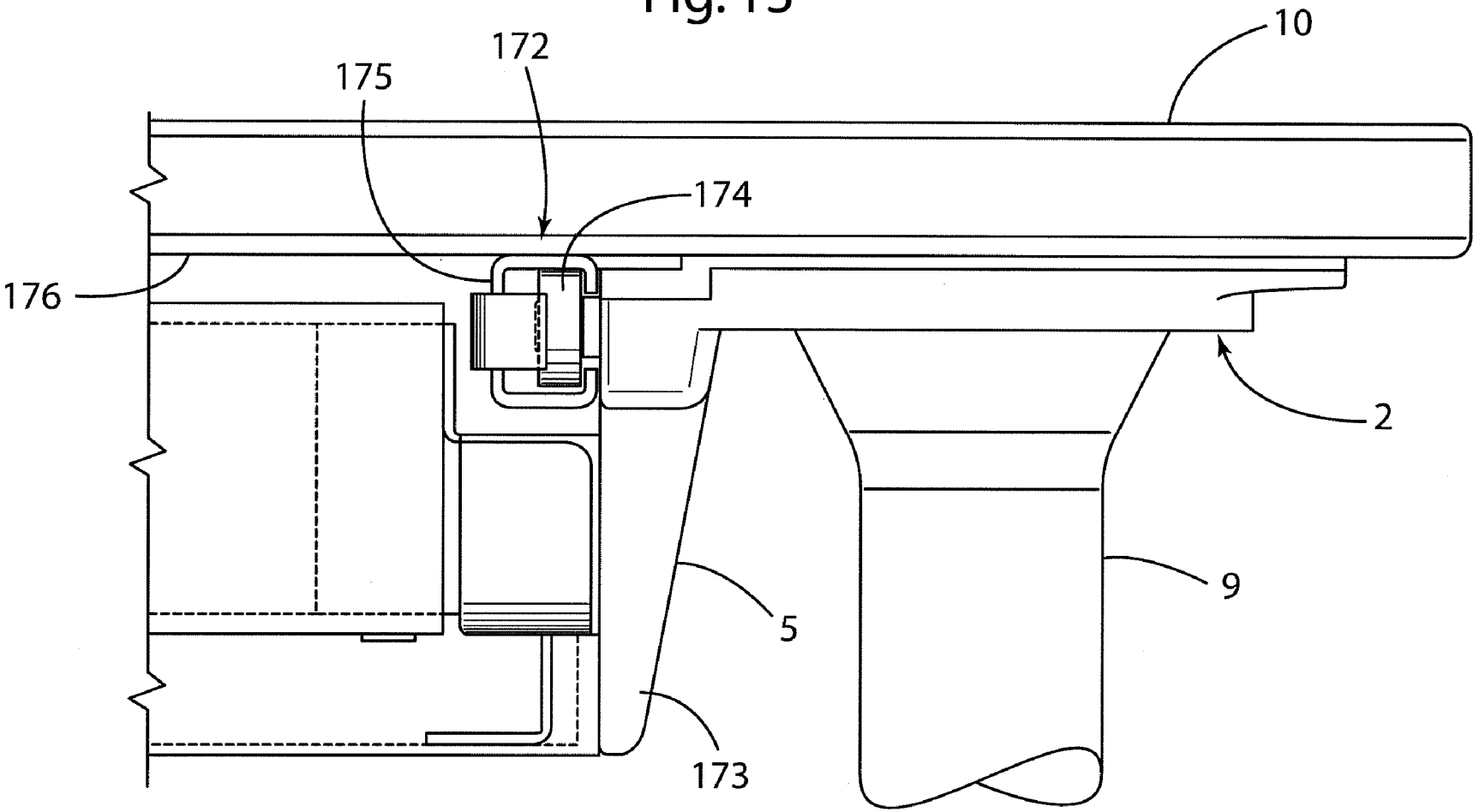
FIG. 13 is a fragmentary view of a portion of the worksurface assembly taken along the line XIII-XIII.

With further reference to FIGS. 12 and 13, a pair of slide assemblies 172 (see also FIG. 1) slidably connect worksurface top 10 to frame 2. End bracket structure 5 includes a downwardly-extending portion 173, and a plurality of rollers 174 are rotatably mounted to the downwardly-extending portion. A C-shaped channel 175 is rigidly mounted to lower side surface 176 of top 10, and rollers 174 engage the C-shaped channel to provide for back and forth movement of the top in the direction of arrow "A" (FIG. 1) relative to frame 2. Rollers 174 and C-shaped channel 175 may be of a known design, such that the details of these components will not be further described herein.

Referring back to FIG. 7-10, a latching or locking mechanism 15 provides for controlled movement of top 10 relative to frame 2. Mechanism 15 includes first and second pulleys 180 and 181, respectively that are pivotably connected to a bracket 182 at pins or pivots 183 and 184, respectively. Bracket 182 is secured to frame 2, such that first and second pulleys 180 and 181 remain stationary relative to frame 2. A first cable 185 has a first end 187 connected to a tension spring 188, and a second end 189 that is connected to a lever 190 at pin or pivot point 194. First cable 185 wraps around first pulley 180. A second cable 186 includes a first end 191 connected to tension spring 188, and a second end 192 connected to lever 190 at pin or connecting point 194 via a tension fitting 193. Tension fitting 193 includes a compression spring 195 that is relatively stiff, and ensures that cables 185 and 186 remain in tension despite dimensional variations in the length of the cables, spacing of pulleys 180 and 181, or the like. Lever 190 is pivotably mounted to bracket 182 (and thereby to frame 2) at pin or pivot 196. Top 10 is connected to mechanism 15 at first end 191 of second cable 186, such that the top moves with the first end.

Mechanism 15 is in the configuration shown in FIG. 8 when top 10 is in the closed position. If a user pulls on top 10 without moving lever 190, a tension force on cable 186 is generated due to the force transmitted into cable 186 at end 191. Because compression spring 195 is relatively stiff, top 10 cannot move an appreciatable distance. Also, because the centerline of second cable 186 extends along a line that is "inside" of pin or pivot point 196 of lever 190, tension force on second cable 186 will tend to drive lever 190 in a clockwise direction about pin or pivot point 196, such that mechanism 15 remains in the locked position shown in FIG. 8.

To release mechanism 15, a user applies a force to outer end 197 of lever 190 to thereby rotate the lever in a counterclockwise direction about pivotable pin 196. As lever 190 rotates, pin 194 connecting cables 185 and 186 to lever 190 moves downwardly, such that the centerline of cable 186 is "below" pin or pivot point 196 as shown in FIG. 9. As shown in FIG. 9, end 191 of cable 186 begins to move away from second pulley 181, and top 10 also therefore begins to move. As lever 190 rotates from the position from FIG. 8 to the position shown in FIG. 2 due to a force applied by a user, spring 188 stretches, thereby storing energy. If a user releases the force applied to lever 190 when it is in the position of FIG. 9, spring 188 will contract, thereby returning the mechanism 15 to the configuration shown in FIG. 8. Although cables 185 and 186 have equal tension when mechanism 15 is in configuration of FIG. 9, the moment generated about pin or pivot point 196 by cable 185 is greater, thereby cause mechanism 15 to change from the configuration of FIG. 9 to the configuration of FIG. 8 if the force applied to lever 190 is removed.

If, however, a user continues to push lever 190, thereby rotating the lever in a counterclockwise position, the lever will reach a "center" position wherein pin or pivot 194 of lever 190 is vertically aligned with pin or pivot 196 along line "V" FIG. 10. When mechanism 15 is at the "center" position, the mechanism will tend to remain in this position even if the external force applied to lever 190 is removed. However, if lever 190 is rotated slightly past the "center" position, spring 188 will contract, thereby pulling the lever to the open position shown in FIG. 10. As spring 188 contracts, end 191 of cable 186 moves toward first pulley 180, and top 10 also moves outwardly to the open position due to contraction of the spring. Spring 188 is configured to provide sufficient tension to move top 10 outwardly without application of additional force by a user once mechanism 15 has moved just beyond the center position. Although the center position has been described as being the position wherein lever 190 extend vertically along line "V" (FIG. 10), the actual center point occurs when the moments generated by cables 185 and 186 on lever 190 about pin or pivot point 196 are equal. Depending upon the relative locations of pin or pivot points 183, 184, 194, and 196, the center position may occur when lever 190 is not vertical.

When top 10 is in the open position and mechanism 15 is in the configuration shown in FIG. 10, a force tending to the close the top can be applied to the top by a user. This force acts on end 191 of cable 186, thereby tending to stretch spring 188. If the external force applied to top 10 by a user is large enough, the tension force on cable 185 will rotate lever 190 in a clockwise direction until it passes through the center position. Once lever 190 passes the center position, spring 188 will generate sufficient force to pull top 10 closed, and return mechanism 15 to the configuration shown in FIG. 8. If, however, a user releases the forces applied to top 10 before mechanism 15 reaches the center position, tension generated by spring 188 will return the mechanism from the center position to the configuration shown in FIG. 10, thereby closing the top. In addition to mechanism 15, stops may be utilized to restrict movement of top 10 relative to frame 2 in both the open and closed positions.

Figure 14:
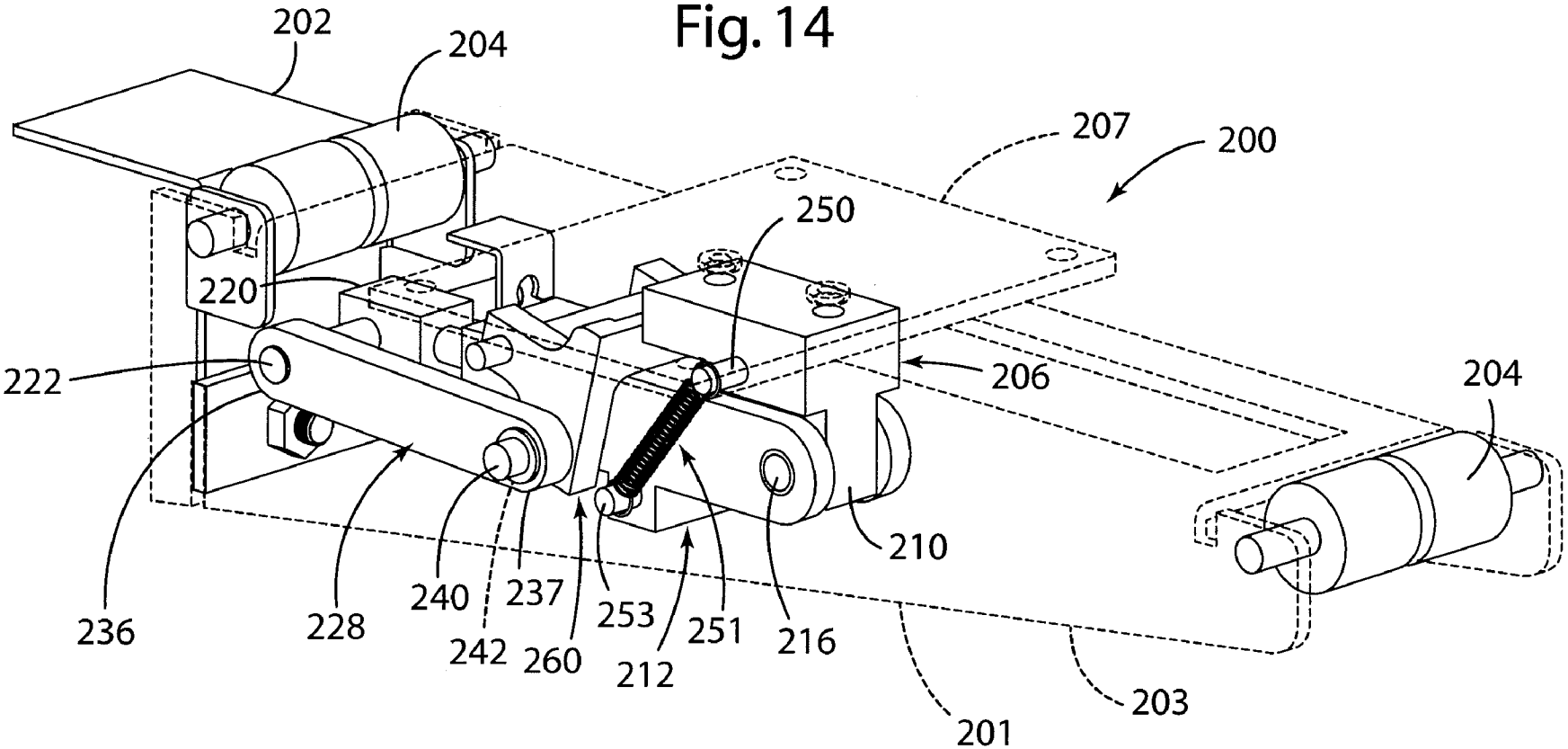
FIG. 14 is an isometric view of a latching or lock mechanism according to another aspect of the present invention.
Figure 15:
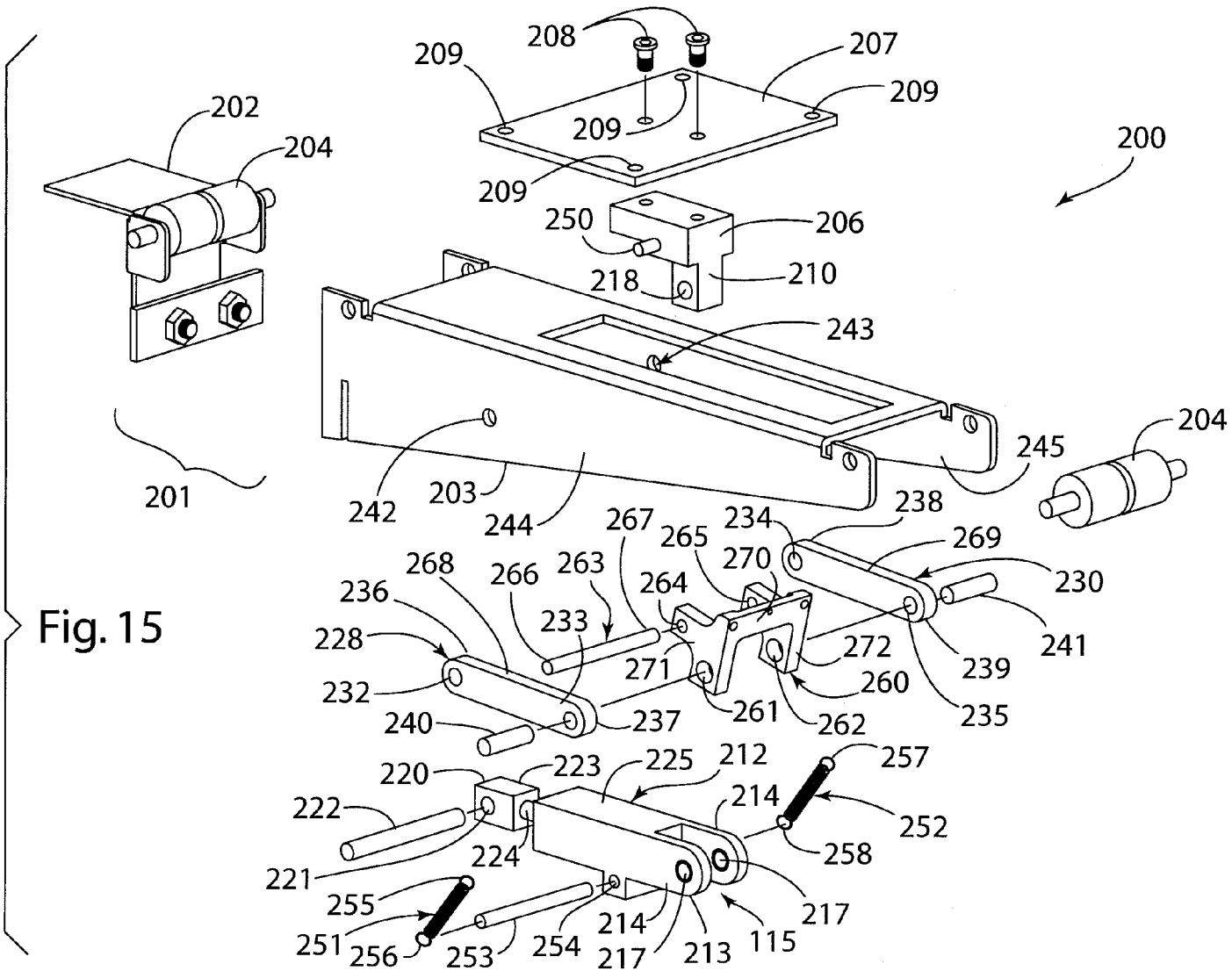
FIG. 15 is an exploded isometric view of the mechanism of FIG. 14.

With further reference to FIGS. 14 and 15, a mechanism 200 according to another aspect of the present invention may also be utilized to control movement of top 10 relative to frame 2. Mechanism 200 includes a bracket 201 including a base portion 202 that is configured to rigidly connect the mechanism with cross member 3, and an outwardly-extending cantilevered portion 203. A pair of rollers 204 are rotatably mounted to bracket 201, and engage lower surface 176 of top 110 to moveably support the top. Mechanism 200 includes a base member 206 that is secured to a plate 207 by threaded fasteners 208. Threaded fasteners or the like (not shown) are received in openings 209 of plate 207 to thereby rigidly secure base member 206 and plate 207 to lower side surface 176 of top 10. A main link 212 includes an end 213 having a pair of spaced-apart extensions 214 forming a gap 115 therebetween. When assembled, extension 210 of base member 206 is positioned in gap 215 between extensions 214 of main link 212, and a pin 216 extends through openings 217 in extensions 214, and through opening 218 in base member 206 to thereby pivotably interconnect end 213 of main link 212 to the base member. Main link 212 also includes an end member 223 that is connected to a body portion 225 of main link 212 by a rod 224. As described in more detail below, a compression spring is disposed within the body portion 225, such that end member 223 can move axially somewhat relative to body portion 225. A first link 228 includes a first opening 232 at a first end 236, and a second opening 233 at a second end 237. Similarly, a second link 230 includes a first opening 234 at a first end 238, and a second opening 235 at a second end 239. When assembled, pin 222 extends through openings 232 and 234 in links 228 and 230, respectively, and through opening 221 of end member 223 of main link 212 to thereby pivotably interconnect first ends 234 and 236 of links 230 and 228, respectively, to second end 220 of the main link.

A pin 240 is received in opening 233 at second end 237 of link 228, and pin 240 is also received in opening 242 in side wall 244 of cantilever portion 203 of bracket 201 to thereby pivotably interconnect end 237 of link 228 to bracket 201. Similarly, a pin 241 is received in opening 235 of link 203 and opening 243 in side wall 245 of bracket 201 to thereby pivotally interconnect second end 239 of link 230 to the bracket.

A pin 250 is mounted to base member 206 with opposite ends protruding therefrom, and a pin 253 is received in an opening 254 through body member 225 of main link 212. End 255 of spring 251 connects to pin 250, and end 256 of spring 251 connects to pin 253.

Similarly, end 257 of spring 252 connects to pin 250, and end 258 of spring 252 connects to pin 253. As described in more detail below, springs 251 and 252 are in tension, and therefore rotatably bias main link 212 about pin 216 such that main link 212 tends to rotate towards top 10.

A release link 260 is positioned between links 228 and 230. Release link 260 includes openings 261 and 262 that receive pins 240 and 241, respectively, to thereby pivotably mount release link 260 to bracket 201. When assembled, pin 263 is received in openings 264 and 265 of release link 260. As described in more detail below, in use, end 266 of pin 263 contacts edge surface 268 of link 228, and end 267 of pin 263 contacts edge surface 269 of link 230 upon rotation of release link 260 to thereby rotate links 228 and 230 and release mechanism 200. Release link 260 includes opposite side portions 271 and 272, and a central portion 270 that extends between opposite side portions 271 and 272. As also described in more detail below, a cable is connected to central portion 270 to selectively rotate release link 260 about pins 240 and 241 to release mechanism 200.

Figure 17:
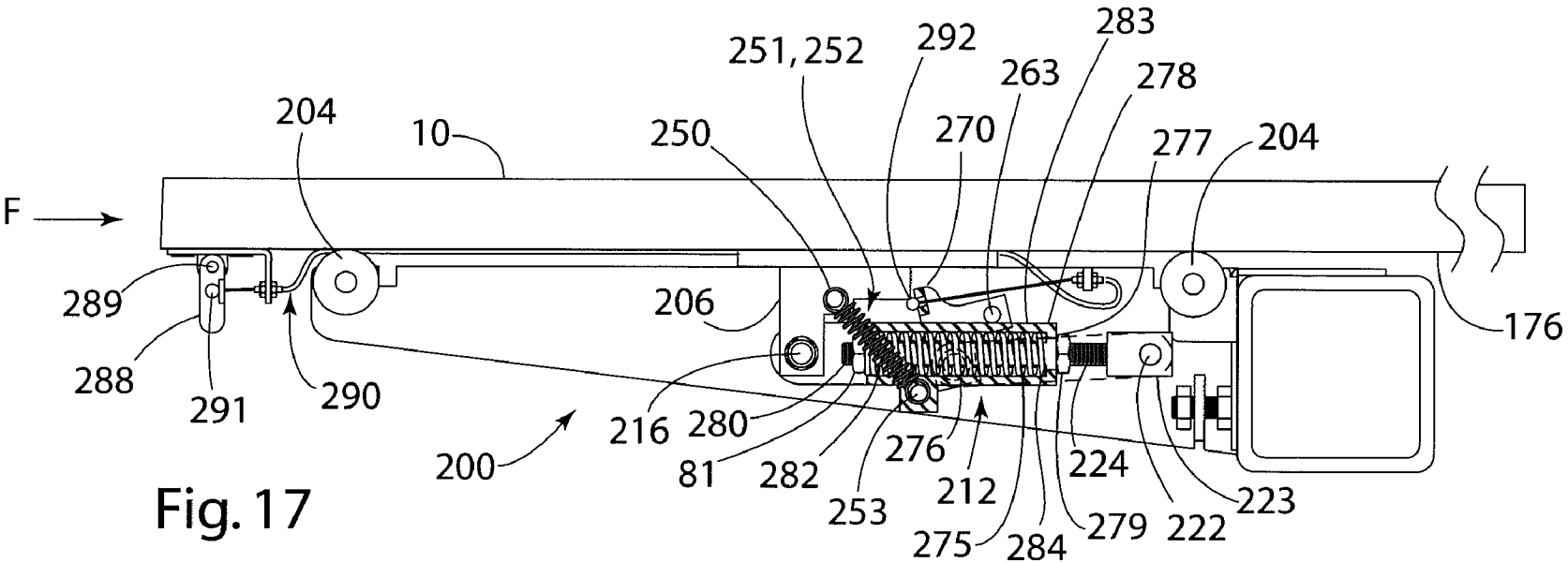
FIG. 17 is a side view of the mechanism of FIG. 14 with the worksurface top member in a closed position.

With further reference to FIG. 17, body member 225 of main link 212 includes an internal cavity 276, and a compression spring 275 is disposed within the internal cavity. In the illustrated example, rod 224 comprises a threaded rod that extends through an opening 277 in a first end 278 of body member 225, and a threaded nut 279 adjustably limits the travel of threaded rod 224 relative to body member 225 upon contact with first end 278 of body member 225. A threaded nut 281 and washer are disposed on an end 280 of threaded rod 224, and engage a first end 282 of compression spring 275. A second end 283 of compression spring 275 bears against an inner side surface to a 4 of body member 225 directly adjacent opening 277, such that compression spring 275 biases threaded rod 224 inwardly toward body portion 225. However, threaded nut 279 prevents travel of threaded rod 224 past a selected position.

If mechanism 200 is in the fully closed or locked position of FIG. 17, and a user applies a force "F" to top 10, main link 212 will be put into compression, and the length of main link 212 will not change significantly due to threaded nut 279 acting on end 278 of body member 225. However, if a user pulls on top 10 in a direction opposite of arrow "F" (FIG. 17), main link 212 will be placed in tension. If enough force is applied, compression spring 275 will be compressed somewhat, and threaded rod 224 will move relative to main body portion 225, thereby causing main link 212 to lengthen somewhat. However, compression spring 275 is quite stiff, such that top 10 cannot be moved appreciably unless mechanism 200 is released.

Figure 16:
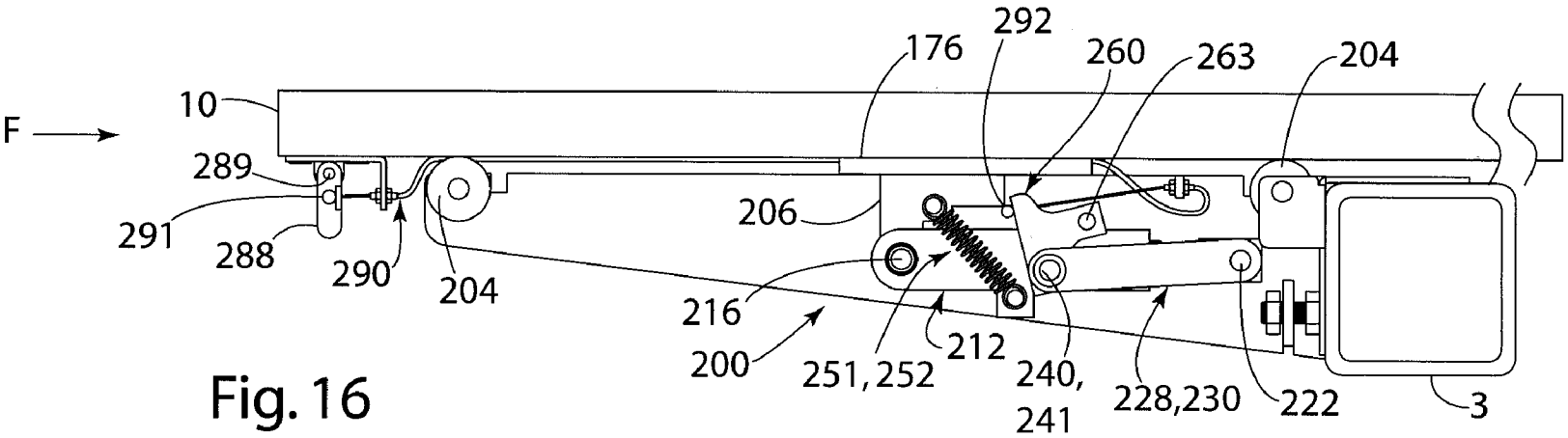
FIG. 16 is a side view of the mechanism of FIG. 14 with the worksurface top member in a closed position.
Figure 20:
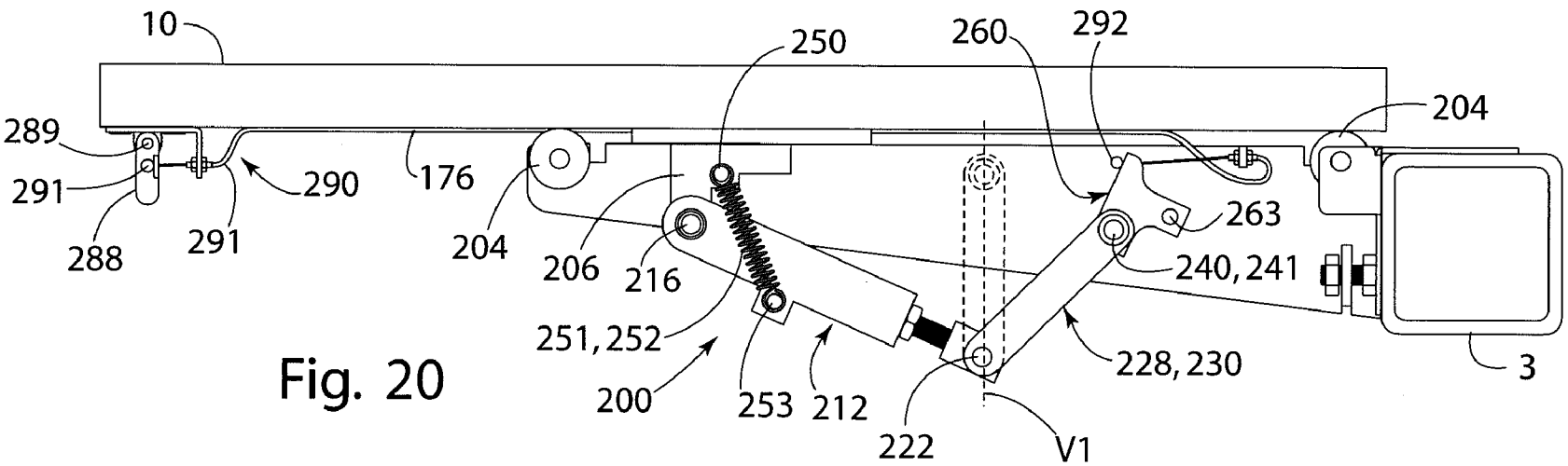
FIG. 20 is a view of the mechanism of FIG. 14 with the worksurface top member in an open position.
Figure 21:
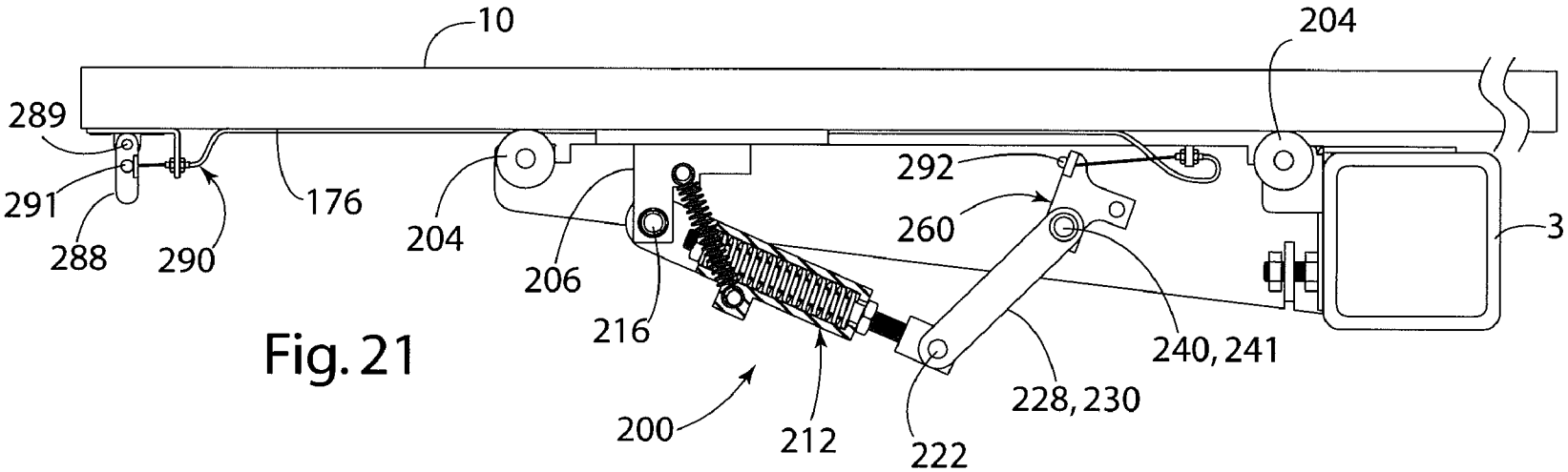
FIG. 21 is a view of the mechanism with the worksurface top member in an open position.

When top 10 is in the fully closed position of FIGS. 16 and 17, the pivotable interconnection point (pins 240, 241) of links 228 and 230 to bracket 201 is below a line extending through the pivotable interconnection (pin 216) of main link 212 to base member 206 and the pivotable connection (pin 222 of main link 212) to links 228 and 230. As discussed above, if a user pulls on top 10 in a direction opposite arrow "F" (FIGS. 16 and 17), main link 212 is placed in tension. The force generated on pin 222 and links 228 and 230 thereby tends to cause links 228 and 230 to rotate in a counterclockwise direction about pins 240 and 241, thereby preventing mechanism 200 from moving to an open position as shown in FIGS. 20 and 21.

Figure 18:
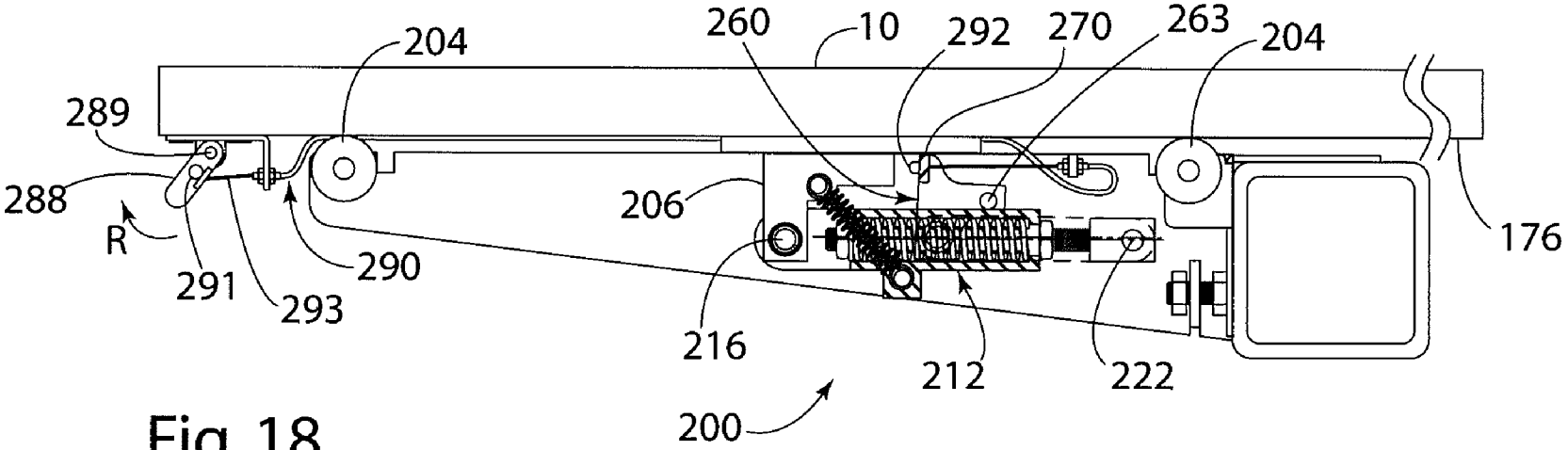
FIG. 18 is a cross-sectional view showing the mechanism of FIG. 14 as it is being released from the closed position of FIGS. 16 and 17.

A cable assembly 290 operably interconnects release lever 288 and release link 260, and a first end 291 of a cable 293 is connected release lever 288, and a second end 292 of cable 293 is connected to central portion 270 of release link 260. To release mechanism 200, a user rotates a release lever 288 in a direction of arrow "R" about pivot point 289. Although lever 288 is shown as being pivotable about a horizontal axis formed by pin 289, lever 288 may be mounted in such a way that it pivots about a vertical axis. Rotation of release lever 288 in the direction of arrow "R" thereby tensions cable 293, causing release link 260 to rotate in a clockwise direction about pins 240 and 241. As release link 260 rotates, ends 266 and 267 of pin 263 contact edge surfaces 268 and 269 of links 228 and 230, respectively, thereby causing links 228 and 230 to rotate in a counterclockwise direction (FIGS. 16 and 17) about pins 240 and 241. As links 228 and 230 rotate, pin 228 moves to a position where it is in a direct line with pins 240, 241 and pin 216 (FIG. 18). Further rotation of links 228 and 230 causes mechanism 200 to move to a partially open configuration as shown in FIG. 19.

Figure 19:
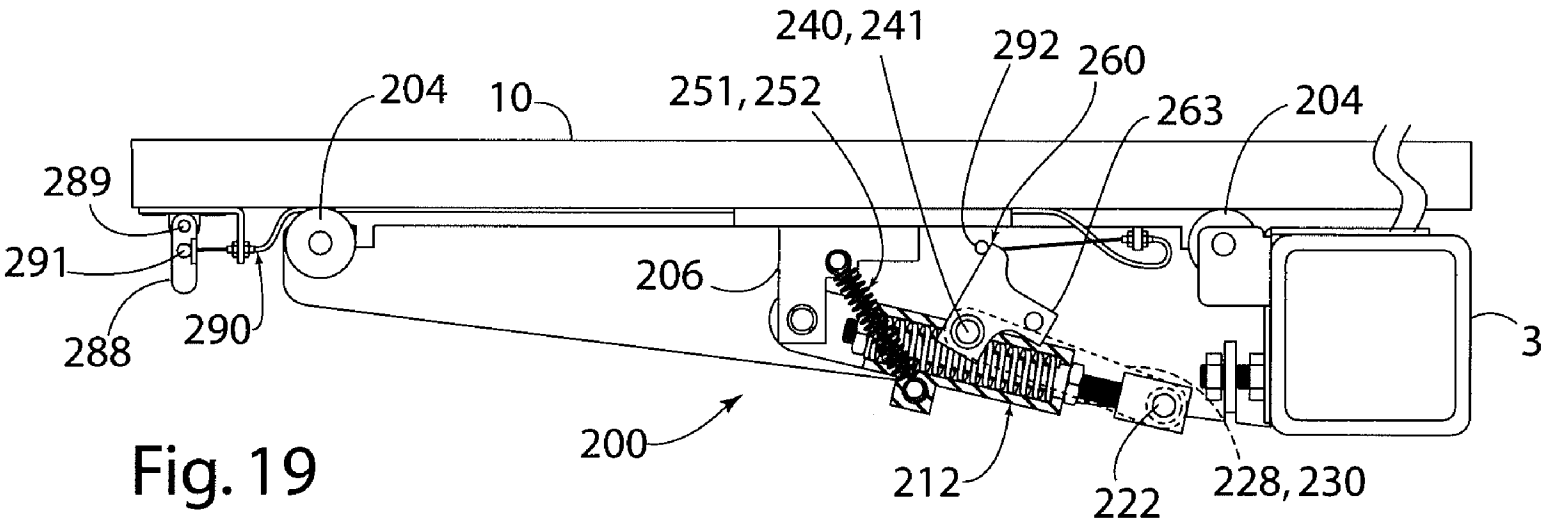
FIG. 19 is a cross-sectional view of the mechanism of FIG. 14 as the worksurface top member is opening.

Once mechanism 200 moves past the position shown in FIG. 18 towards the partially open configuration shown in FIG. 19, mechanism 200 is no longer locked. If an external force is then applied to top 10, mechanism 200 will move from the partially open configuration of FIG. 19 to the fully open configuration of FIGS. 20 and 21. As mechanism 200 moves from the partially open configuration of FIG. 19 to the fully open configuration of FIGS. 20 and 21, links 228 and 230 rotate in a clockwise direction about pins 240 and 241. At a mid point, the center lines of links 228 and 230 are positioned to define a center point represented by line "V1" (FIG. 20). As discussed above, tension springs 251 and 252 generate a moment biasing main link 212 in a counter clockwise direction about pin 216. When mechanism 200 is at the center position (i.e., links 228 and 230 are aligned with line "V1", the mechanism is in a "dead" or center position, and springs 251 and 252 do not cause the mechanism to move to either the closed position or the open position. If, however, top 10 is moved to a partially open position as shown in FIG. 19 (i.e., a position between the closed position and the center position), and the external force applied to top 10 by a user is removed, springs 251 and 252 will cause top 10 to move back to the fully closed position. Conversely, if top 10 is moved to a position past the center position (i.e. between the center position and the fully open position), springs 251 and 252 will cause the mechanism to move to the fully open position shown in FIGS. 20 and 21 even if the external force applied by the user is released once mechanism 200 is moved just beyond the center position represented by line "V1".

To move top 10 from the fully open position (e.g. FIGS. 20 and 21) to the closed position (e.g. FIGS. 16 and 17), a user applies an external force "F" (FIG. 16) to top 10. Force "F" will cause mechanism 200 to begin to close. If mechanism 200 is moved beyond the center position represented by line "V1" (FIG. 20), top 10 will move to the fully closed position due to the force generated by springs 251 and 252, even if external force "F" is removed immediately after mechanism 200 moves past the center position. If external "F" is, however, removed prior to mechanism 200 reaching the center position, the mechanism will cause top 10 to move outwardly back to the fully extended position as shown in FIGS. 20 and 21.

Figure 22:
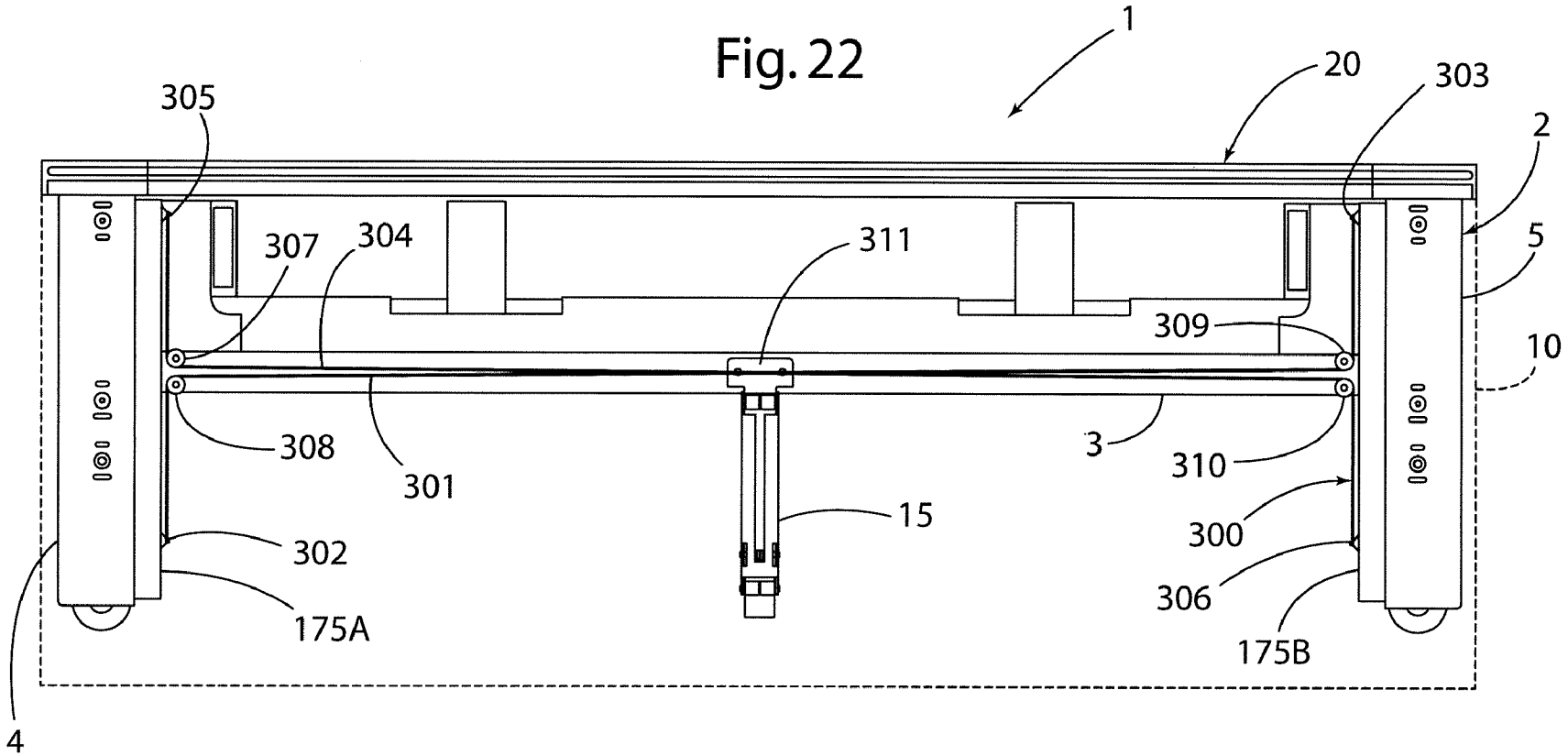
FIG. 22 is a plan view of the worksurface assembly showing an anti-racking mechanism.

With further reference to FIG. 22, worksurface assembly 1 may include a mechanism 300 that ensures top 10 translates linearly with respect to frame structure 2 without "racking" or binding. Mechanism 300 includes a first cable 301 having a first end 302 secured to a first C-channel 175A, and a second end 303 that is secured to a second C-channel 175B. A second cable 304 includes a first end 305 that is secured to first C-channel 175A, and a second end 306 that is secured to a second C-channel 175B. C-channels 175A and 175B are fixed to top 10, and move with the top. Pulleys 307 and 308 are rotatably mounted to cross member 3 adjacent end bracket structure 4, and pulleys 309 and 310 are rotatably mounted to cross member 3 adjacent end bracket structure 5. First cable 301 is supported by pulleys 308 and 310, and second cable 304 is supported by pulleys 307 and 309. First cable 301 and second cable 304 cross at center point 311. In use, ends 302, 303, 305, and 306 of cables 301 and 304 move with top 10, and tension on cables 301 and 304 ensures that the top translates linearly with respect to frame structure 2 without "racking" or binding.

Figure 23:
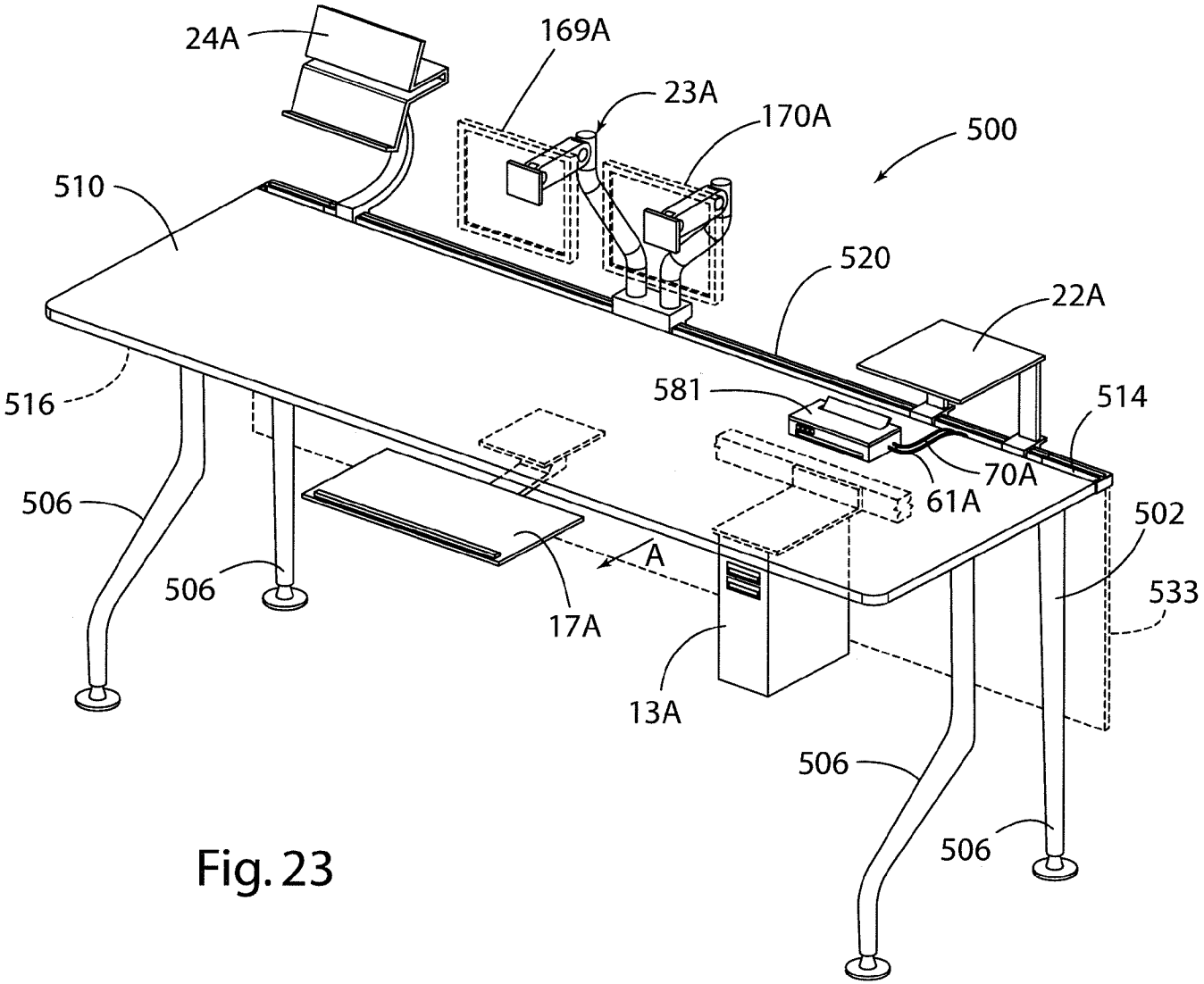
FIG. 23 is an isometric view of a worksurface assembly according to another aspect of the present invention.
Figure 24:
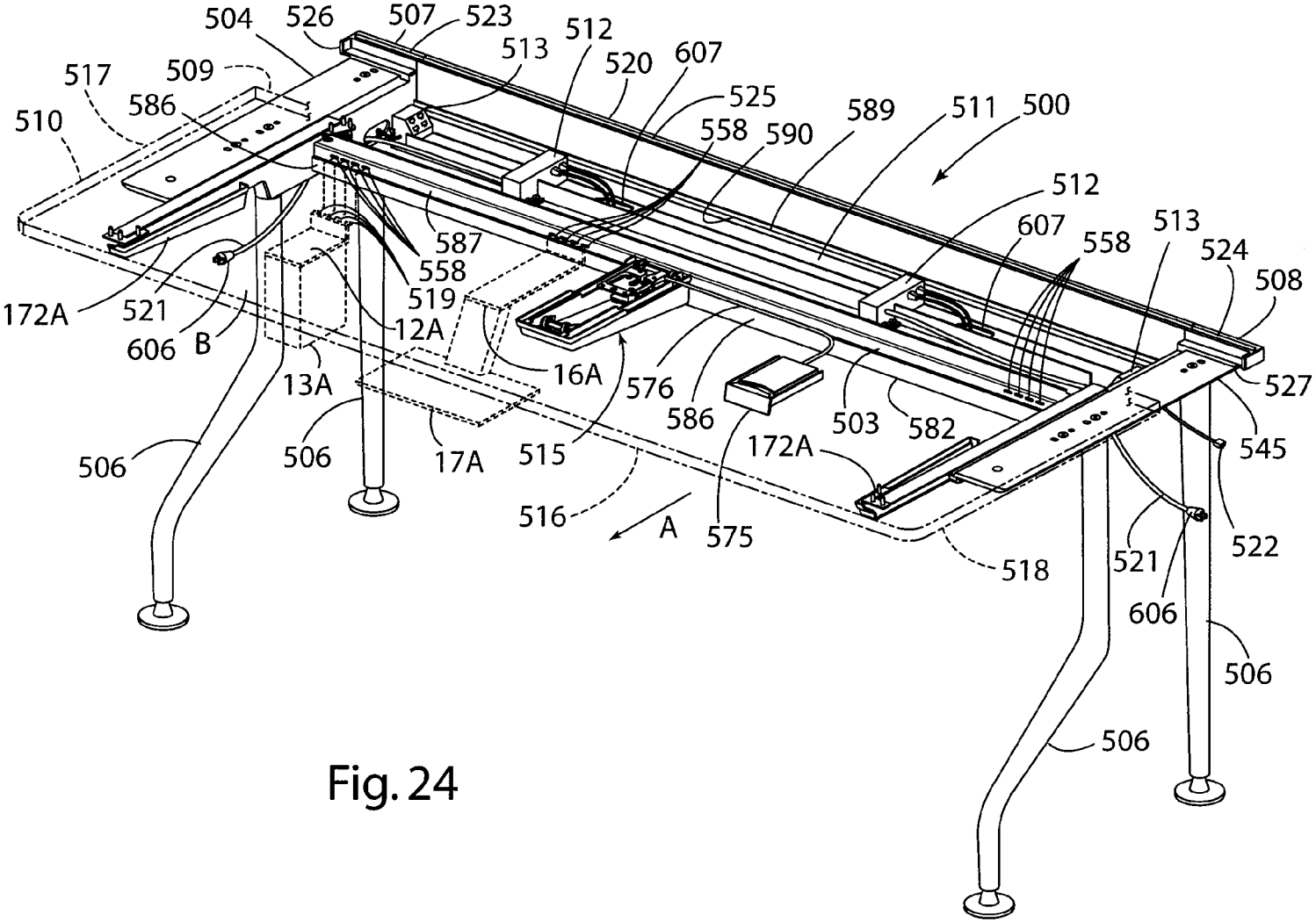
FIG. 24 is an isometric view of the worksurface assembly of FIG. 23 showing the worksurface member in an open position.
Figure 25:
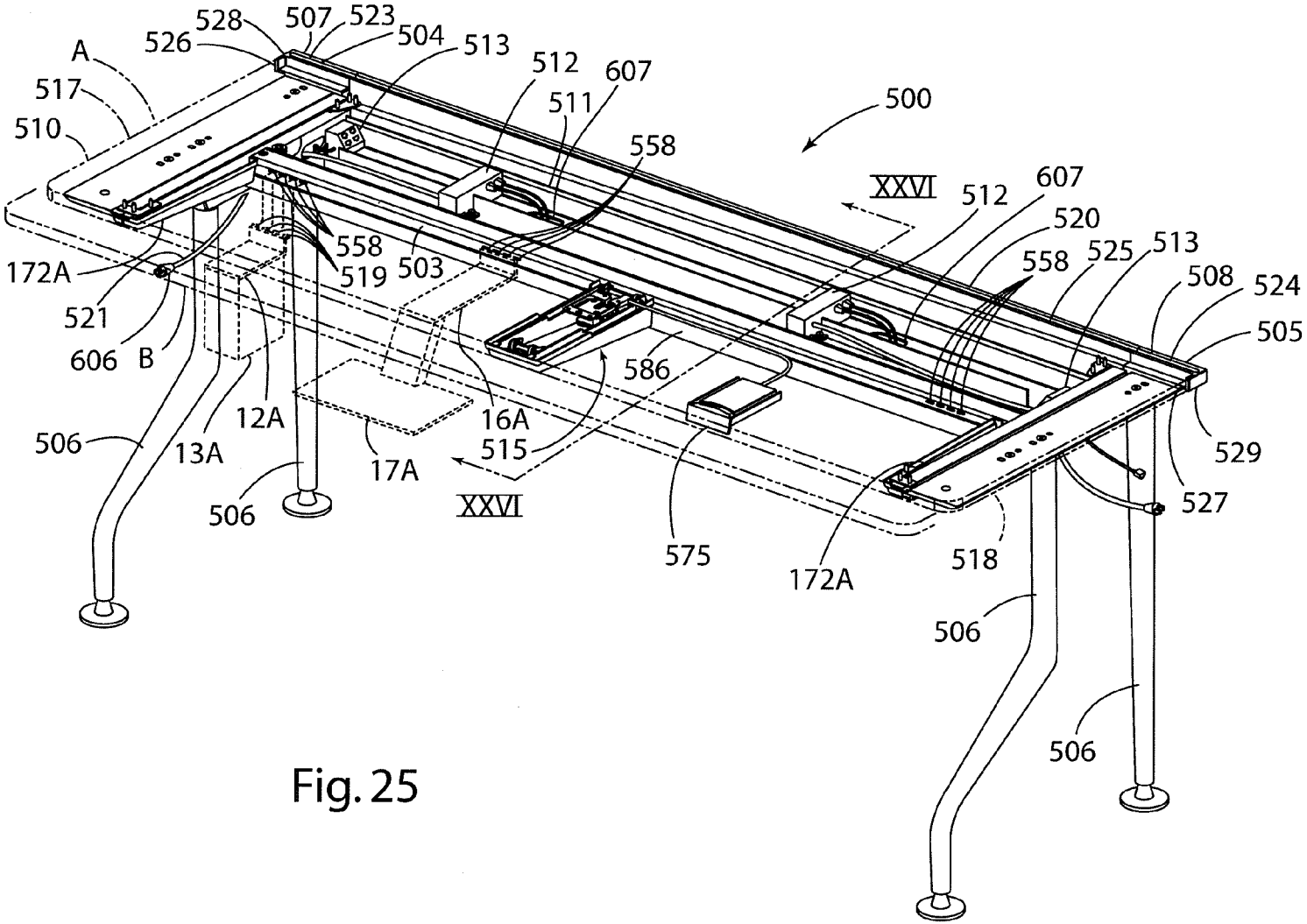
FIG. 25 is an isometric view of the worksurface assembly of FIG. 23 showing the worksurface member in a closed position.

With further reference to FIGS. 23-25, a worksurface assembly 500 according to another aspect of the present invention includes a support structure 502 that may comprise a plurality of legs 506 that are attached to brackets 504 and 505. Support structure 502 may also include a cross-member 503, and a rail 520, each of which have opposite ends connected to bracket structures 504 and 505.

Referring again to FIG. 23, a plurality of accessory units such as an angle document support unit 24A, a monitor support arm 23A, and a shelf 22A may be secured to rail 520 utilizing a connecting arrangement that is substantially the same as described in more detail above in connection with FIGS. 11, 11A, and 11B. As discussed in more detail below, one or more privacy screens 533 may be mounted to rail 520 in upwardly and/or downwardly extending configurations. Also, a keyboard support platform 17A and a computer 13A may be mounted to support structure 502. A support structure or arm 16A includes horizontally-extending hooks 519 that are received in horizontal slots 558 in front side 587 of cross member 503. A screw (not shown) or other suitable fastener is utilized to secure arm to cross member 503. Arm 16A supports keyboard support platform 17. A computer support structure 12A may be utilized to support a computer CPV 13A. Support structure 12A includes horizontally-extending hooks 519 that are received in slots 558 in front side 587 of cross member 503. Screws (not shown) or other suitable fasteners may be utilized to secure support structure 12A to cross member 503. In the illustrated example, there are several groups of slots 558, such that arm 16A and support 12A can be installed in selected ones of slots 558 at a user-selected horizontal position. In the illustrated example, worksurface assembly 500 is configured to be supported in a free standing manner on a floor surface by legs 506. However, bracket structures 504 and 505 may also be configured to mount worksurface assembly 500 to a partition system or the like (not shown). Thus, support structure 502 does not necessarily need to include legs 506, but rather could comprise a variety of structures configured to support worksurface assembly 500 in a variety of configurations.

Worksurface member 510 is configured to move between an extended or open position "B" (FIG. 24) and a retracted or closed position "A" (FIG. 25). A pair of slide assemblies 172A movably support worksurface member 510 on support structure 502. Slide assemblies 172A may have substantially the same construction as slide assemblies 172 described in more detail above in connection with the worksurface assembly of FIG. 13. Worksurface assembly 500 may include an anti-racking mechanism that is substantially similar to the mechanism described in more detail above in connection with FIG. 22. As described in more detail below, worksurface assembly 500 may include a tray structure 511 that provides for routing of power and data lines 521 and 522, respectively, and for mounting of power and data blocks 512 and 513, respectively.

Figure 27:
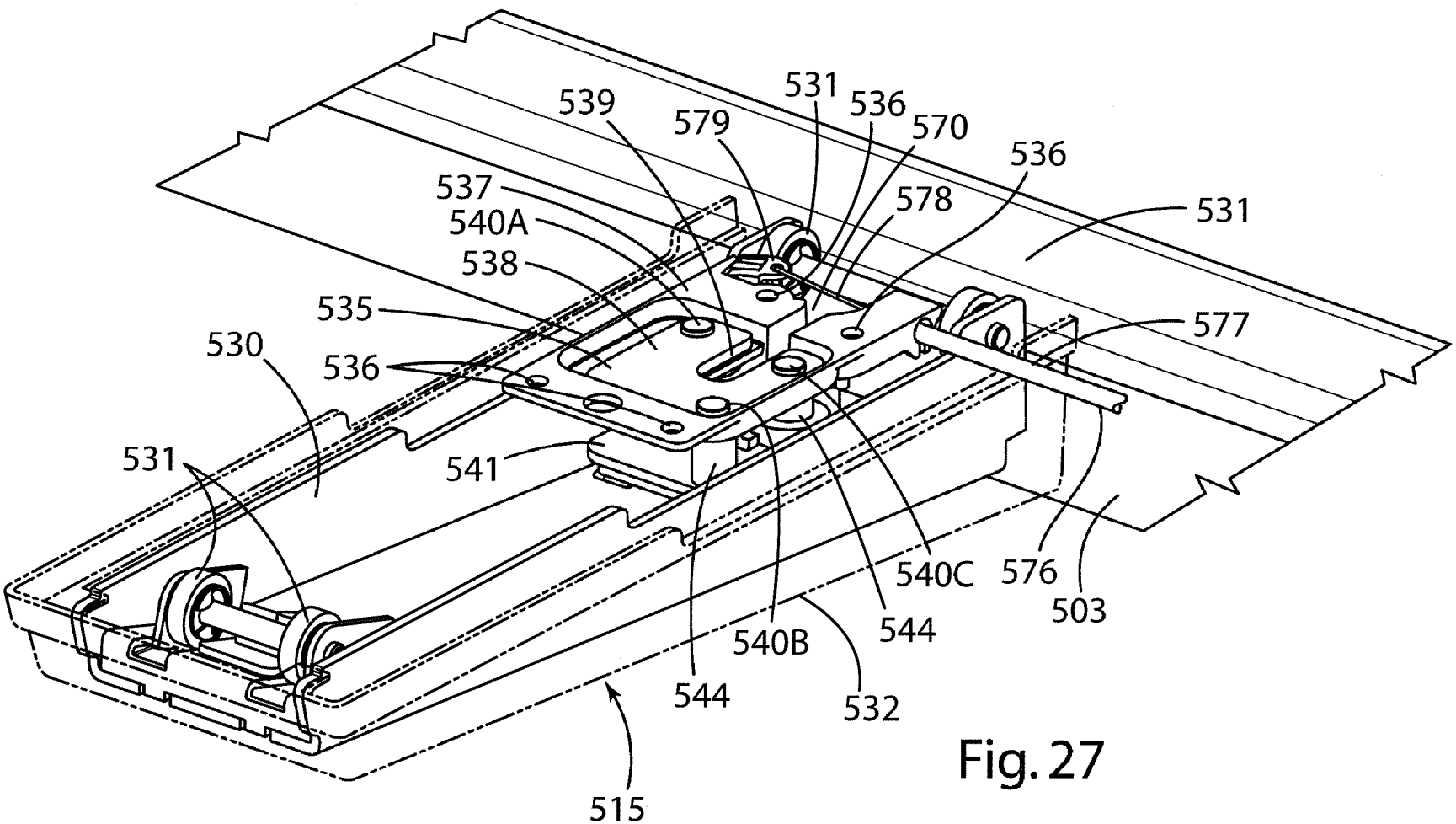
FIG. 27 is a partially fragmentary isometric view of the motion control device of the worksurface assembly of FIG. 23.

With further reference to FIG. 27, motion control or latching device or mechanism 515 includes a first bracket 530 that is secured to cross member 503. Mechanism 515 includes a plurality of rollers 531 that engage a lower surface 516 (FIG. 23) of worksurface member 510 to movably support a central portion of worksurface member 510. As discussed above, worksurface member 510 is also slidably supported by slide assemblies 172A. In the illustrated example, cross member 503 comprises a two inch by two inch square cross-sectional shape. First bracket 530 is also formed of metal, and it is welded to cross member 503. An optional cover 532 may be utilized to cover first bracket 530 to improve the appearance of motion control device 515. In the illustrated example, cover 532 is made of a polymer material.

Figure 28:
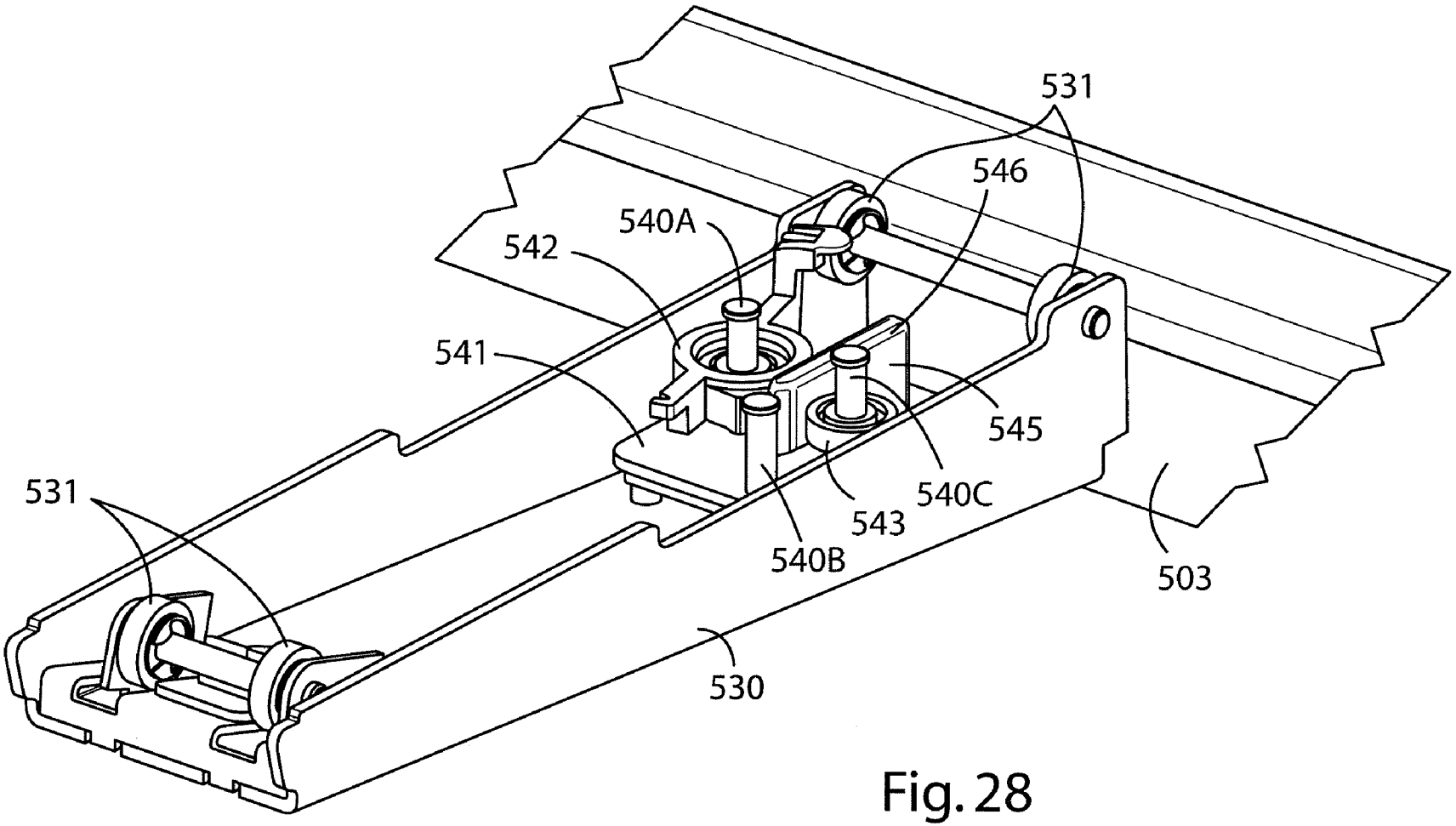
FIG. 28 is a partially fragmentary isometric view of the motion control device of FIG. 27.

A second bracket 535 includes a first component 537 having a plurality of apertures 536 (FIG. 27) that receive threaded fasteners (not shown) to secure second bracket 535 to lower surface 516 of worksurface member 510, such that second bracket 535 moves with worksurface member 510. Second bracket 535 includes a first component 537 that may be made of a polymer material, and a second component 538 that may be constructed of metal. Second component 538 has a shape that is generally plate-like, with a cut out portion 539. Second bracket 535 also includes a third component 541 that is rigidly interconnected with second component 538 by a plurality of pins 540A-540C (see also FIG. 28). Third component 541 is also substantially plate-like, and may be made of metal or other suitable material. First component 537 of second bracket 535 includes cylindrical portions 544 that are sandwiched between second component 538 and third component 541 to act as spacers, and pins 540A-540C extend through openings in cylindrical portions 544 of first component 537. Although second component 538 and third component 541 are shown as being two separate pieces, they may also comprise a single part made from polymer, metal, or other suitable material.

A first engagement member such as a cam or cleat 542 is pivotably mounted to pin 540A, and a roller 543 is rotatably mounted on pin 540C. A second engagement or blade member 545 is mounted to first bracket 530, and includes a blade or protrusion 546 that is disposed between cam 542 and roller 543 when worksurface member 510 is in the retracted/closed position shown in FIG. 28. As discussed in more detail below, cam 542 and roller 543 move with worksurface member 510, whereas blade member 545 remains stationary relative to cross member 503.

Figure 29:
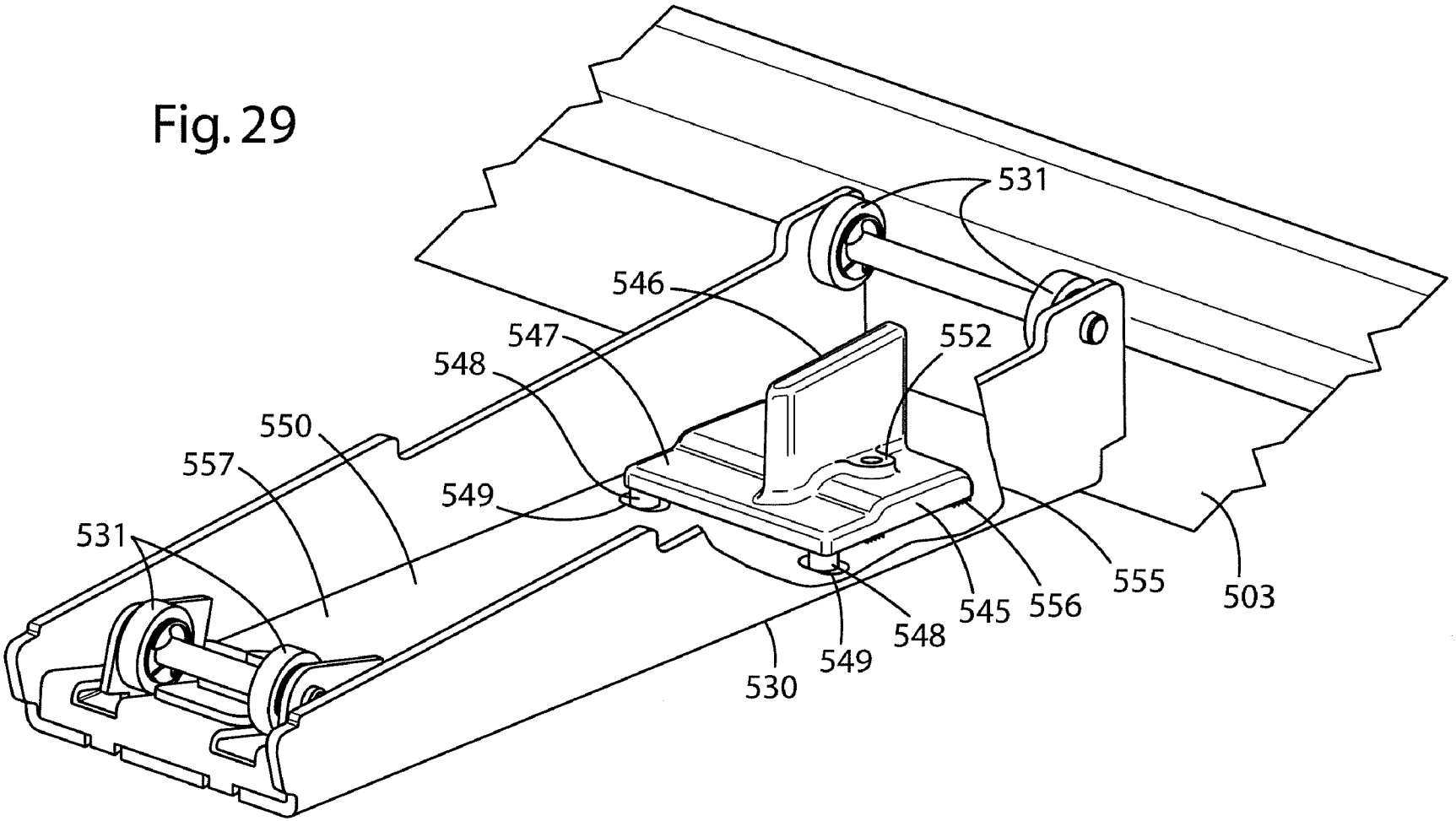
FIG. 29 is a partially fragmentary isometric view of the motion control device of FIG. 27 wherein some of the components have been removed to show the remaining components.
Figure 30:
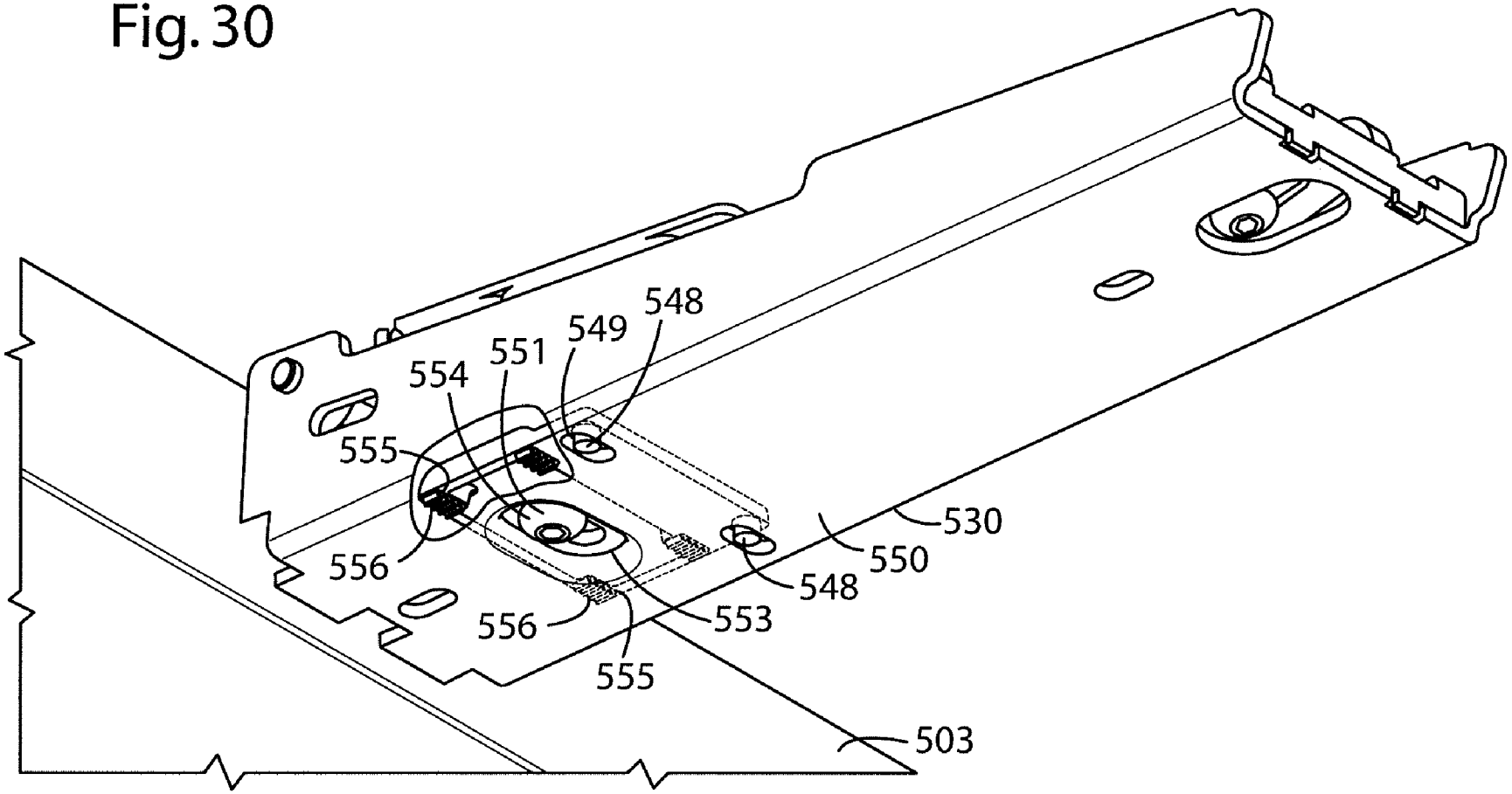
FIG. 30 is a partially fragmentary isometric view of a portion of the device of FIG. 29.

With further reference to FIGS. 29 and 30, blade member 545 includes a base 547 having a pair of bosses or protrusions 548 that extend through slots 549 in a bottom sidewall 550 of first bracket 530. A bolt 551 (FIG. 30) is threadably received in a threaded opening 552 (FIG. 29) of blade member 545, and a head 554 of bolt 551 as received in a recessed area 553 in sidewall 550 of first bracket 530. Blade member 545 includes a pair of pads 555 (FIG. 30) having teeth 556 that frictionally engage upper surface 557 of first bracket 530 upon tightening of bolt 551. The pins and slots 548 and 549, respectively, bolt 551, and pads 555 together provide for side-to-side adjustment of the position of blade member 545 relative to first bracket 530.

In use, when worksurface member 510 is moved to the retracted or closed position (FIG. 31), blade 546 is positioned between cam 542 and roller 543. A tension spring 560 is connected to an end 561 of arm 562 of cam member 542, and spring 560 is also connected to a boss 563 or other connector located on second bracket 535. Spring 560 generates a force tending to rotate cam member 542 in a counter clockwise direction, thereby biasing cam surface 564 of cam member 542 into contact with first side surface 565 of blade 546. Cam surface 564 contacts first side surface 565 of blade 546 at a contact point 566 that is offset a distance "X" from axis of rotation 567 of cam member 542. As worksurface member 510 is moved from the extended (open) position to the retracted (closed) position, end 568 of blade 546 contacts cam surface 564, thereby causing cam member 542 to rotate in a clockwise direction, with the side surface 565 of blade 546 slidably contacting cam surface 564. This contact generates a moment in the clockwise direction that overcomes the counterclockwise force generated by spring 560. However, if a user pulls outwardly on a worksurface member 510 when worksurface member 510 is in the retracted (closed) position (FIG. 31), friction between cam surface 564 (FIG. 31) and first side surface 565 of blade 546 generates a force tending to rotate cam member 542 in a counter clockwise direction. The shape of cam surface 564 causes cam member 542 to wedge tightly against first side surface 565 of blade 546, thereby preventing movement of second bracket assembly 535 in the direction of the arrow "F". This, in turn, prevents movement of the worksurface member 510 from the retracted or closed position. As cam member 542 becomes tightly wedged against first side surface 565 of blade 546, a substantial force that is normal to first side surface 565 is generated. However, roller 543 contacts second side surface 569 of blade 546 to thereby react forces generated by cam member 542 on blade 546. Because pins 540A and 540C are supported by second component 538 (FIG. 27) and third component 541, pins 54A and 540C are very rigidly mounted to prevent outward movement of pins 540A and 540C.

With reference back to FIG. 24, a release member 575 is movably mounted to lower surface 516 of worksurface member 510. Movable release member 575 is operably connected to the motion control mechanism or device 515 by a cable 576. With reference to FIG. 27, cable 576 may comprise a Bowden cable having an outer sheath 577 and an inner cable 578. Inner cable 578 is connected to an end fitting 579 of arm 580 (FIG. 31) of cam member 542, such that tension on inner cable 578 generates a release force "R" acting on cam member 542. Release force R tends to rotate cam member 542 in a clockwise direction (FIG. 31), thereby moving cam surface 564 out of engagement with first side surface 565 of blade 546. This releases cam member 542, such that blade 546 can be moved in a direction opposite arrow "F" (FIG. 31), thereby allowing worksurface member 510 to be moved from the retracted (closed) position to the open position. Thus, in use, a user pulls on release member 575 (FIG. 24) to thereby release cam member 542 of motion control device 515, and then pulls outwardly on worksurface member 510 in the direction of arrow "A" (FIG. 24), thereby moving worksurface member 510 from the retracted (closed) position to the extended (open) position.

With reference to FIG. 24, bracket 504 includes a corner portion 507, and bracket 505 includes a corner portion 508. Corner portions 507 and 508 include grooves 523 and 524, respectively, that align with elongated groove or channel 525 in rail 520. Resilient pads or bumpers 526 and 527 are mounted to corners 507 and 508 of brackets 504 and 505, respectively (see also FIG. 32). When worksurface member 510 is shifted to the retracted (closed) position, rear edge 509 of worksurface member 510 contacts resilient pads 526 and 527. As discussed above, motion control mechanism 515 generates a one-way retaining force that permits worksurface member 510 to be moved from the open position to the closed position, but prevents movement of worksurface member 510 from the closed position to the open position, unless motion control mechanism 515 is released utilizing release member 575. The one-way retaining action of motion control mechanism 515 retains the worksurface member 510 against the resilient members 526 and 527. Motion control device 515 and resilient members 526 and 527 thereby tightly retain worksurface member 510 in the closed position in a manner that prevents movement of worksurface member 510 relative to support structure 502. Because motion control mechanism 515 prevents movement of worksurface member 510 towards the open position regardless of the precise position of worksurface member 510 relative to support structure 502 (provided blade 546 is in an engagement with cam surface 564), motion control mechanism 515 and resilient members 526 and 527 together provide for tight closure of worksurface member 510 regardless of dimensional variations or other tolerances that may be present in the various components of the worksurface assembly 500.

Also, the side-to-side position of blade member 545 relative to support structure 2 can be adjusted by loosening bolt 551 (FIG. 30), shifting the position of blade member 545, followed by tightening of bolt 551. In use, bolt 551 may be loosened with worksurface member 510 in the closed position. Worksurface member 510 can then be moved manually side-to-side as required until opposite side edges 517 and 518 (FIG. 25) of worksurface member 510 are aligned with outer surfaces 528 and 529 of brackets 504 and 505, respectively. Bolt 551 can then be tightened to lock blade member 545 to first bracket 530. This ensures that worksurface member 510 will have a proper side-to-side position relative to support structure 2 when in the closed position. This adjustment permits the position of worksurface member 510 to be precisely adjusted relative to support structure 2 when worksurface member 510 is in the closed position, regardless of tolerances that may be present in the various components of worksurface assembly 500. This prevents an unsightly visual affect that would occur if worksurface member 510 were not properly aligned with brackets 504 and 505 of support structure 502.

Figure 31:
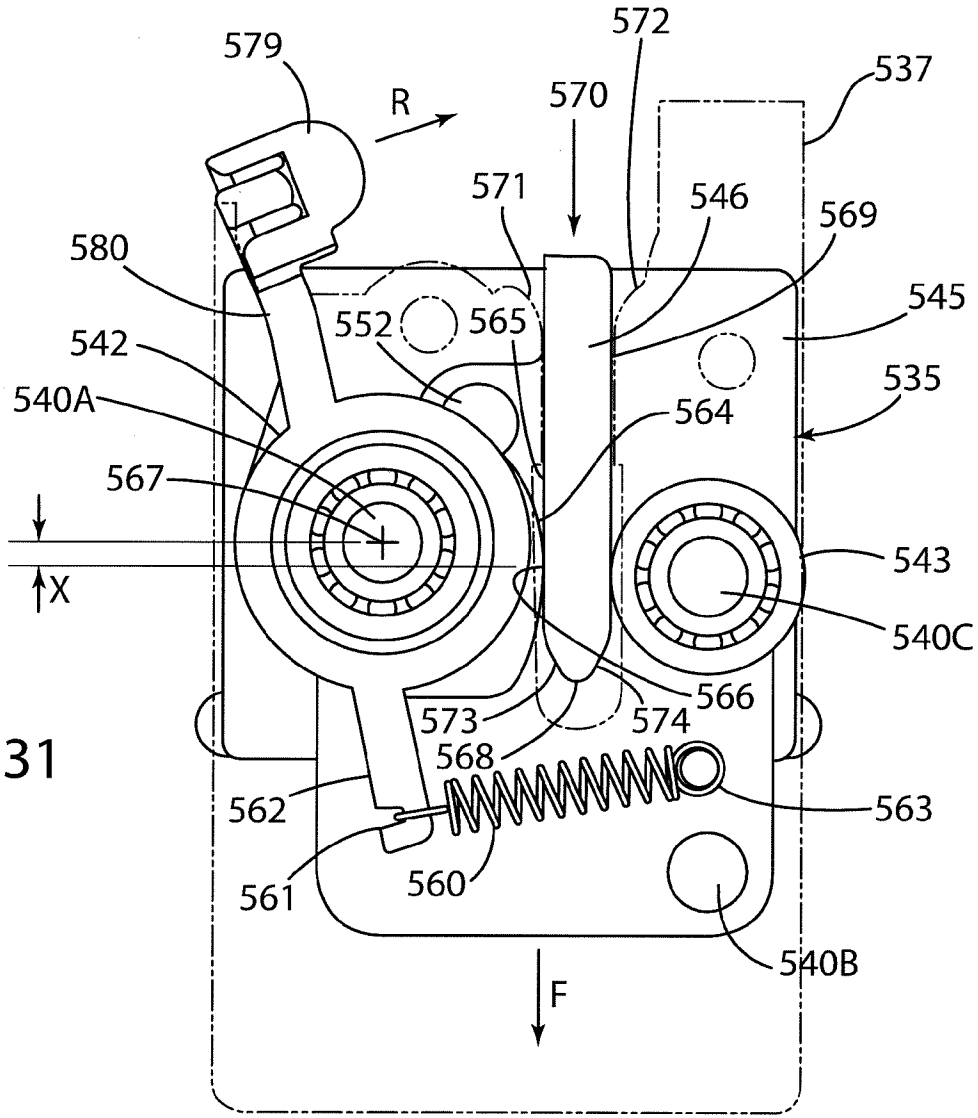
FIG. 31 is a plan view of a portion of the motion control device of FIG. 27.

With reference to FIGS. 27 and 31, first component 537 of second bracket assembly 535 includes a slot 570 that is aligned with cut out 539 of second component 538. Tapered surfaces 571 and 572 of first component 537 act as guide surfaces to align blade 546 with slot 570 as blade 546 enters slot 570 as worksurface member 510 is moved from the open position to the closed position. End 568 of blade 546 includes tapered surfaces 573 and 574. If blade 546 is somewhat misaligned relative to slot 570, as worksurface member 510 is shifted to the closed position the surfaces 573 and 574 of blade 546 contact surfaces 571 and 572, respectively, of first component 537, thereby shifting component 537 and worksurface member 510 in a direction that is transverse relative to the rearward motion of worksurface member 510. This shifts worksurface member 510 sideways (if required) as it is closed to provide proper side-to-side alignment of worksurface member 510 relative to support structure 502 when in the closed position. It will be appreciated that the side-to-side adjustability of blade member 545 relative to support structure 2, in combination with slot 570 and guide surfaces 571 and 572 of first component 537 of second bracket 535, permits proper positioning of worksurface member 510 relative to support structure 502 regardless of tolerances in the various components.

With reference back to FIGS. 24 and 25, worksurface assembly 500 includes a tray structure 511 extending between brackets 504 and 505. Power blocks 512 and data blocks 513 may be mounted on or within tray structure 511 to provide connection points for power lines 61A (FIG. 23) and/or data lines 70A for various items of equipment such as a printer/scanner 581. In general, displays 169A and 170A, computer 13A, and other powered devices utilized in conjunction with worksurface assembly 500 may be connected to the power blocks 512 and/or data blocks 513.

Figure 26:
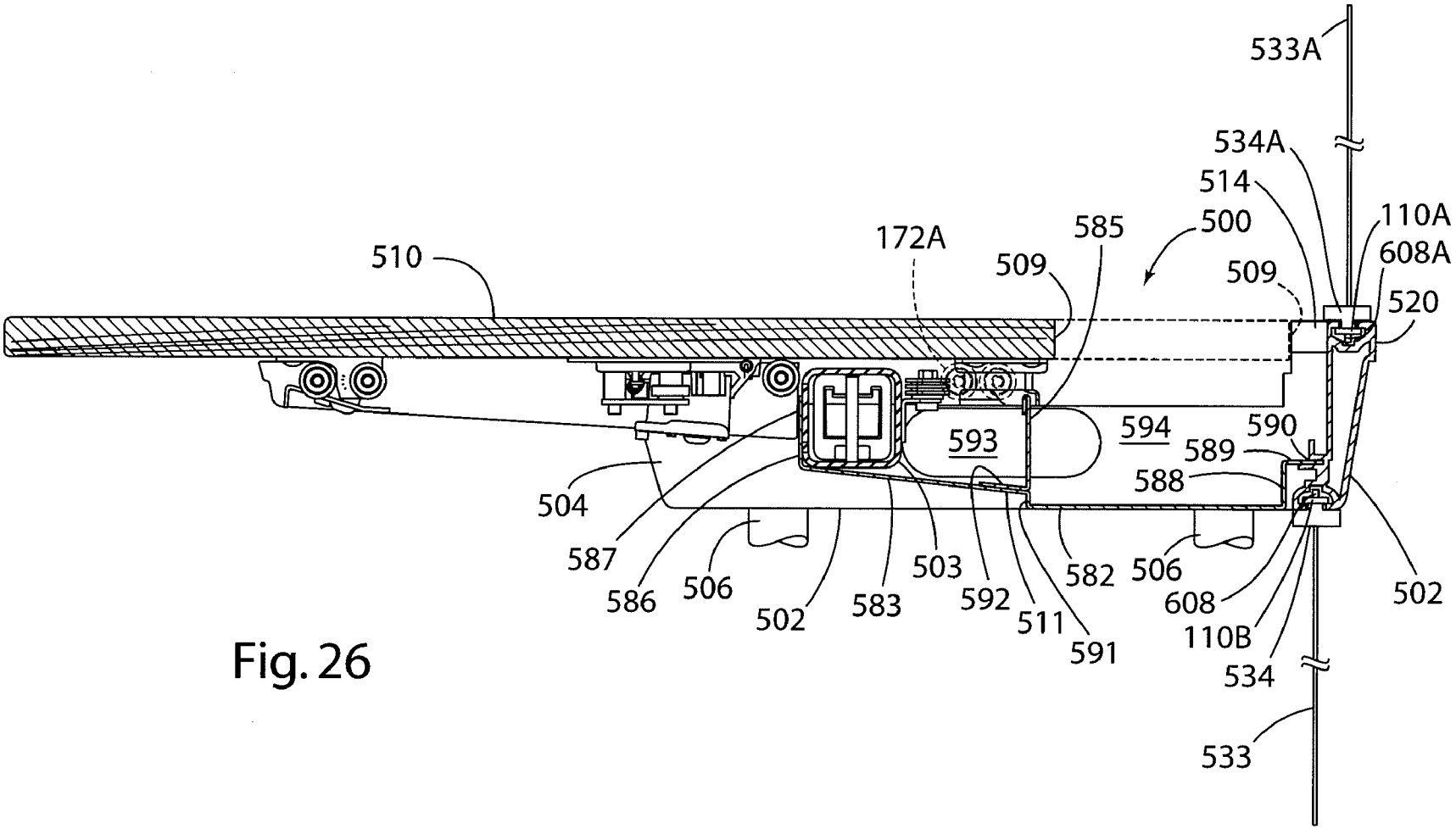
FIG. 26 is a cross-sectional view of the worksurface assembly of FIG. 25 taken along the line XXVI-XXVI.
Figure 32:
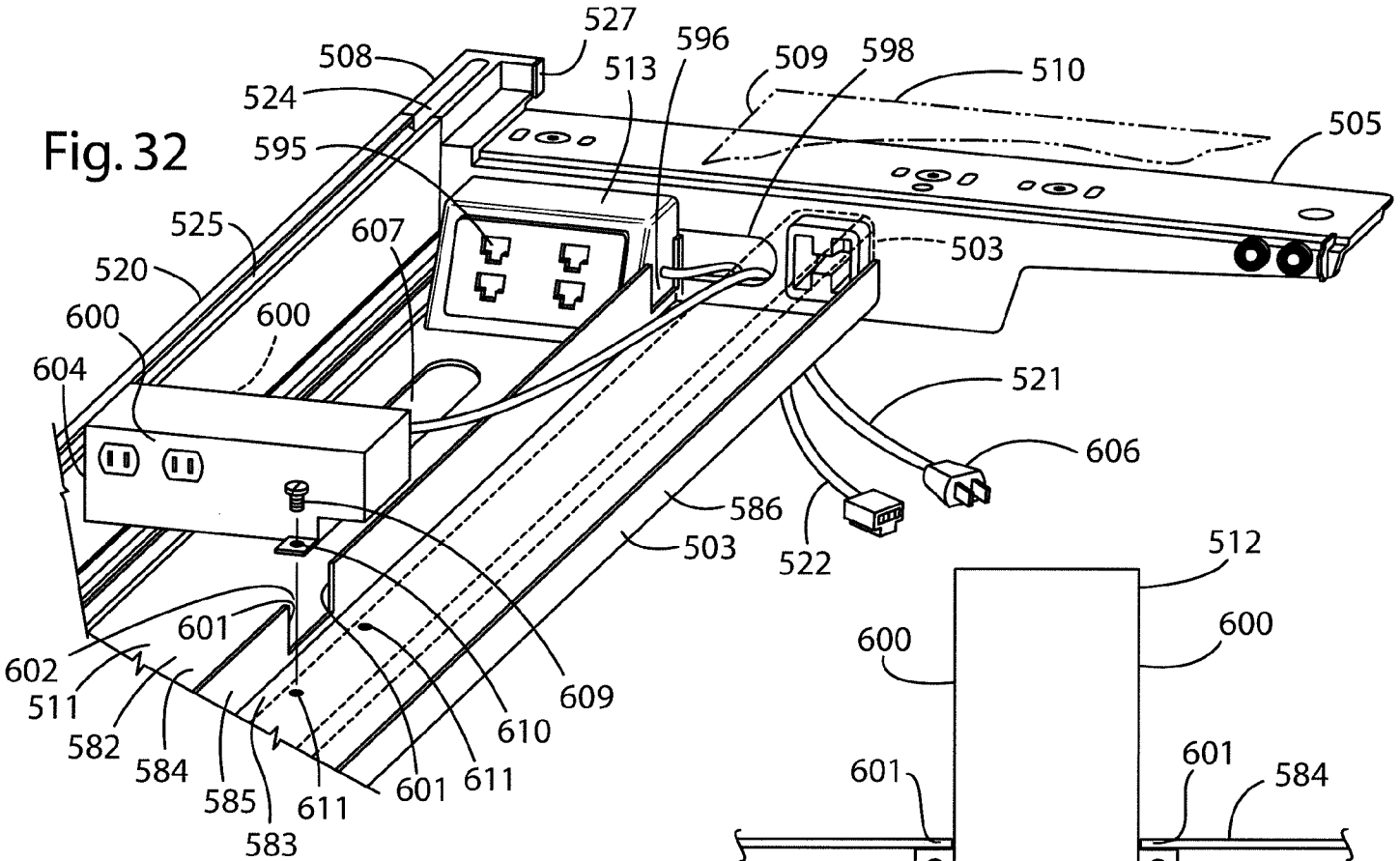
FIG. 32 is a partially fragmentary isometric view of a portion of the worksurface assembly of FIG. 23.

With further reference to FIGS. 26 and 32, tray structure 511 includes a tray member 582 having a front portion 583 with an upwardly-extending flange 586 extending upwardly along a front side 587 of cross member 503. Threaded fasteners or other suitable connectors (not shown) may be utilized to secure flange 586 of tray member 582 to cross member 503. Tray member 582 also includes a rear portion 584 having upwardly and rearwardly-extending flanges 588 and 589, respectively. Rearwardly extending flange 589 is received in a groove or slot 590 in rail or extrusion 520 to thereby support rear portion 584 of tray member 582. Tray member 582 further includes a vertical step 591, and a divider or septum 585 that extends upwardly from tray member 582 at step 591. Divider 585 includes a transversely-extending flange 592 that is secured to front portion 583 of tray member 582 by spot welding, mechanical fasteners (not shown), or other suitable arrangement. Tray member 582 and divider 585 together define a front passageway or space 593, and a rear passageway or space 594. Front and rear passageways 593 extend transversely below worksurface member 510. When worksurface member 510 is in the open position shown in FIG. 26, rear edge 509 of worksurface member 510 is spaced apart from rail 520, thereby providing access to rear passageway or space 594. However, when worksurface member 510 is in the open position, rear edge 509 of worksurface member 510 is positioned above or adjacent divider 585, such that access to front passageway or space 593 is substantially blocked. When worksurface member 510 is in the closed position, rear edge 509 of worksurface member 510 is spaced-apart from rail 520 to form an elongated gap or slot 514 (see also FIG. 23) through which power and data lines 61A and 70A, respectively, can be routed.

Referring again to FIG. 32, data block 513 includes a plurality of data receptacles 595 that are configured to receive conventional data line connectors (not shown). Data supply lines 522 can be routed through a cut out 596 in divider 584, and through an elliptical opening 598 in bracket 505. Data lines 70A that are connected to the data receptacles 595 can be routed through rear passageway 594 as required, and then through gap or slot 514 (FIG. 26) to various electrical devices or the like that may be positioned on worksurface member 510 as required.

Figure 33:
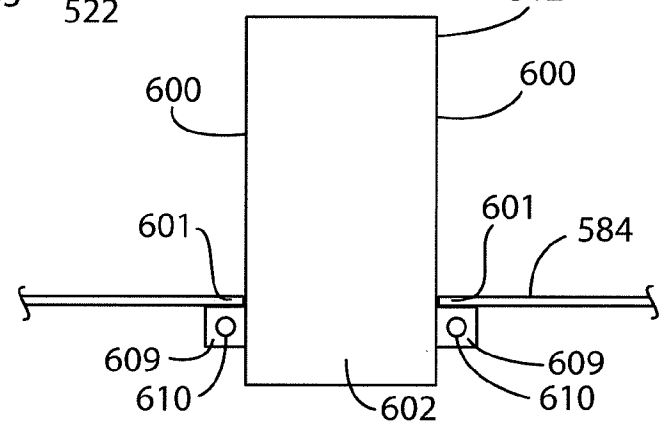
FIG. 33 is a partially fragmentary plan view showing the power block of FIG. 31.

Referring again to FIG. 32, power blocks 512 include slots 599 on opposite side faces 600 of block 512. Slots 599 receive edges 601 formed by cutout 602 in divider 585 (see also FIG. 33). Tabs or flanges 609 extend from power blocks 512, and threaded fasteners 603 or other suitable connectors extend through openings 610 in tabs 609 and through openings 611 in tray member 582 to secure the power block 512 to tray member 582. Power blocks 512 include a plurality of power receptacles 604 on the opposite side faces 600 of power block 512, and power supply lines for various power accessories such as display screens 169A and 170A (FIG. 23), computer 13A, or the like may be plugged into the power receptacle 604. One or more power supply lines 521 extend from power block 512. Power supply lines 521 include conventional plug-type connectors 606. Power supply lines 521 may be routed along front passageway 593, and outwardly through openings 598 in brackets 504 and 505. One or more openings 607 may optionally be formed in rear portion 584 of tray member 582, and power and data lines 61A and 70A, respectively (FIG. 23) may be routed through the openings 607. According to another aspect of the present invention, a modular power system (not shown) may be mounted to tray member 582. The modular power system may be substantially similar to modular power systems of the type utilized in office partition systems and the like. In general, modular power components may be utilized in place of power blocks 512. Alternately, worksurface assembly 500 may be "hard wired" utilizing electrical components (not shown) of the type utilized in "permanent" building walls.

Referring back to FIG. 26, rail 520 includes an upwardly-opening slot 110A that is substantially similar to the slot 110 described in more detail above in connection with FIG. 11A. Rail 520 also includes a downwardly-opening slot 110B may have substantially the same shape and configuration as slot 110 described in more detail above in connection with FIG. 11A. A downwardly-extending privacy screen 533 may be mounted to slot 110B, and an upwardly-extending screen 533A may be mounted to slot 110A of rail 520. Bases 534 and 534A of screens 533 and 533A, respectively, may include connectors 608 and 608A, respectively, that are substantially similar to the connecting arrangement described in more detail above in connection with FIG. 11B. Alternately, connectors 608 and 608A may comprise spring-loaded snap fit connectors (not shown). Screens 533 and 533A may include a plurality of spaced-apart connectors 608 and 608A, respectively, to secure the screens 533 and 533A to the rail 520.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A worksurface assembly comprising:

a support structure;

a power supply system including at least one power supply receptacle;

a worksurface member movably connected to the support structure for movement between extended and retracted positions relative to the support structure, and wherein the worksurface member substantially prevents access to the power supply receptacle when in the retracted position, and permits access to the power supply receptacle when the worksurface member is in the extended position, and wherein the worksurface member moves in a first direction from the extended position to the retracted position, and moves in a second direction from the retracted position to the extended position, the worksurface member defining an enlarged upwardly-facing upper surface;

a movement control device having an engaged configuration permitting movement of the worksurface member in the first direction, and selectively restricting movement of the worksurface member in the second direction to retain the worksurface member in the retracted position, the movement control device further defining a released configuration in which the movement control device permits substantially unrestricted movement in the first and second directions.

2. The worksurface assembly of claim 1, including:

a guide assembly operably interconnecting the worksurface member and the support structure, the guide assembly including spaced apart guide surfaces on one of the worksurface members and the support structure defining a slot therebetween, the guide surfaces tapering away from eachother to define an enlarged open end of the slot, the guide assembly further including a guide member on the other of the worksurface member and the support structure that contacts at least one of the guide surfaces and shifts the worksurface member in a direction that is transverse to the first direction as the worksurface member moves towards the retracted position to provide side-to-side alignment of the worksurface member relative to the support structure.

3. The worksurface assembly of claim 2, wherein:

the guide member comprises a blade that is mounted to the support structure.

4. The worksurface assembly of claim 3, wherein:

the side-to-side position of the blade relative to the support structure can be adjusted to thereby adjust the position of the worksurface member relative to the support structure when the worksurface member is in the retracted position.

5. The worksurface assembly of claim 3, wherein:

the blade comprises a projection having generally parallel opposite side faces, leading and trailing edges, and a distal edge extending between the leading and trailing edges; and wherein:

the leading edge enters the gap in the guide structure as the worksurface member approaches the retracted position.

6. The worksurface assembly of claim 5, wherein:

the opposite side faces define a first dimension therebetween, and the leading edge includes opposite side surfaces that taper towards one another to define a second dimension therebetween that is significantly less than the first dimension.

7. The worksurface assembly of claim 1, wherein:

the power supply system includes an upwardly-opening tray structure configured to support power lines therein, and wherein the worksurface member substantially covers the tray structure when the worksurface member is in the retracted position, and wherein the worksurface member does not cover at least a substantial portion of the tray structure when the worksurface member is in the extended position.

8. The worksurface assembly of claim 7, wherein:

the worksurface member defines opposite side edges and front and rear edges extending between the opposite side edges;

the worksurface assembly defines a rear portion;

the support structure includes an elongated portion extending along the rear portion of the worksurface assembly, wherein the elongated portion is spaced-apart from the rear edge of the worksurface member when the worksurface member is in the retracted position to define a gap through which power lines can be routed from above the worksurface member to the power supply receptacle.

9. The worksurface assembly of claim 8, wherein:

the tray structure includes a generally upright divider wall defining front and rear spaces within the tray structure that are separated by the divider wall, and wherein the power supply receptacle is mounted to the divider wall; and including:

a power line having a first end connected to the power supply receptacle, the power line extending through at least a portion of the front space and out of the tray structure whereby a second end of the power line can be connected to an external power source.

10. The worksurface assembly of claim 9, wherein:

the worksurface member substantially covers the front and rear spaces within the tray structure when the worksurface member is in the retracted position, and wherein the worksurface member substantially covers the front space without covering the rear space to the extent it would significantly restrict access to the power supply receptacle when the worksurface member is in the extended position.

11. A worksurface assembly wherein:

a support structure;

a power supply system including at least one power supply receptacle;

a worksurface member movably connected to the support structure for movement between extended and retracted positions relative to the support structure, and wherein the worksurface member substantially prevents access to the power supply receptacle when in the retracted position, and permits access to the power supply receptacle when the worksurface member is in the extended position, and wherein the worksurface member moves in a first direction from the extended position to the retracted position, and moves in a second direction from the retracted position to the extended position, the worksurface member defining an enlarged upwardly-facing upper surface;

a movement control device permitting movement of the worksurface member in the first direction, and selectively restricting movement of the worksurface member in the second direction to retain the worksurface member in the retracted position; and wherein the movement control device includes a first engagement member attached to one of the support structure and the worksurface member, and a second engagement member attached to the other of the support structure and the worksurface member such that the first engagement member moves relative to the second engagement member upon movement of the worksurface member relative to the support structure, and wherein:

the first engagement member is biased into engagement with the second engagement member and permits movement of the worksurface member in the first direction and substantially prevents movement of the worksurface member in the second direction.

12. The worksurface assembly of claim 11, wherein:

a movable release member operably connected to the first engagement member such that movement of the release member disengages the first engagement member from the second engagement member and permits movement of the worksurface member in the second direction.

13. The worksurface assembly of claim 12, wherein:

the first engagement member is pivotably attached to the one of the support structure and the worksurface member for rotation about a pivot axis.

14. The worksurface assembly of claim 13, wherein:

the second engagement member includes a second engagement surface that is generally planar;

the first engagement member includes a first engagement surface that contacts the second engagement surface.

15. The worksurface assembly of claim 14, wherein:

the first engagement member comprises a cam having a curved outer surface defining a non-constant radius about the pivot axis.

16. The worksurface assembly of claim 15, wherein:

the first engagement surface comprises a smoothly curved cam surface defining a non-constant radius about the pivot axis.

17. The worksurface assembly of claim 15, wherein:

the cam is mounted to the worksurface member and the second engagement member is mounted to the support structure.

18. The worksurface assembly of claim 15, including:

a resilient member biasing the curved outer surface of the cam into contact with the second engagement member; and wherein:

the movable release member is operably connected to the first engagement member by an elongated flexible member.

19. A worksurface assembly comprising:

a support structure;

a power supply system including at least one power supply receptacle;

a worksurface member movably connected to the support structure for movement between extended and retracted positions relative to the support structure, and wherein the worksurface member substantially prevents access to the power supply receptacle when in the retracted position, and permits access to the power supply receptacle when the worksurface member is in the extended position, and wherein the worksurface member moves in a first direction from the extended position to the retracted position, and moves in a second direction from the retracted position to the extended position, the worksurface member defining an enlarged upwardly-facing upper surface;

a movement control device permitting movement of the worksurface member in the first direction, and selectively restricting movement of the worksurface member in the second direction to retain the worksurface member in the retracted position; and at least one resilient stop member limiting movement of the worksurface member in the first direction when the worksurface member is in the retracted position and biasing the worksurface member in the second direction when the worksurface member is in the closed position such that the one resilient stop member and the movement control device substantially prevents movement of the worksurface member in the first and second directions, respectively, when the worksurface member is in the retracted position.

20. A worksurface system comprising:

a support structure including a pair of spaced apart bracket structures, wherein the support structure is configured to support the worksurface system;

a worksurface member defining a front portion, a rear portion, opposite end portions, and a horizontally enlarged upper surface;

an elongated rail member having opposite ends connected to the bracket structures, and having an upwardly-opening slot extending along at least a portion of the rear portion of the worksurface member, the elongated rail member having a horizontally-facing side surface and an upwardly-facing upper surface; and an accessory unit supported on the rail member, the accessory unit including at least one upright support structure having a connecting structure at a lower end thereof, the connecting structure including an extension received in the slot of the elongated rail member, and a second surface facing the extension and contacting the horizontally-facing side surface of the elongated rail member.

21. The worksurface system of claim 20, wherein:

the upwardly-opening slot is defined by parallel spaced-apart surfaces defining a gap therebetween, and wherein the surfaces extend to opposite ends of the rail whereby the slots define open opposite ends that open horizontally outwardly at the opposite ends of the rail;

the bracket structures each include an upwardly-opening slot portion aligned with the open opposite ends of the upwardly-opening slot of the elongated rail member, the slot portions including opposed surfaces that are aligned with the parallel spaced apart surfaces defining the elongated slot in the rail member, and an end surface extending between the opposed surfaces.

22. The worksurface system of claim 20, including:

an elongated cross member having opposite ends connected to the bracket structures; and:

an upwardly-opening tray structure extending between the elongated rail member and the elongated cross member.

23. The worksurface system of claim 22, wherein:

the worksurface member is movably mounted to the support structure and translates fore and aft between extended and retracted positions, wherein the worksurface member substantially covers the tray structure when the worksurface member is in the retracted position, and wherein the worksurface member defines a rear edge that is spaced apart from the rail member to provide access to the tray structure when the worksurface member is in the extended position.

24. The worksurface system of claim 22, including:

at least one power supply unit connected to the tray structure, wherein, the power supply unit includes electrical power receptacles facing outwardly on opposite sides thereof.

25. The worksurface system of claim 24, wherein:

the position of the power supply unit relative to the cross member can be adjusted.

26. The worksurface system of claim 25, wherein:

the tray structure defines opposite ends; and including:

inwardly-facing data receptacles at the opposite ends of the tray structure.

27. The worksurface system of claim 20, wherein:

the worksurface member defines a rear edge that is spaced apart from the elongated rail member to define a gap for routing of utility lines between the elongated rail member and the worksurface member.

28. A worksurface assembly comprising:

a support structure;

a power supply system including at least one power supply receptacle;

a worksurface member movably connected to the support structure for movement between extended and retracted positions relative to the support structure, and a plurality of intermediate positions between the extended and retracted positions, and wherein the worksurface member substantially prevents access to the power supply receptacle when in the retracted position, and permits access to the power supply receptacle when the worksurface member is in the extended position, and wherein the worksurface member moves in a first direction from the extended position to the retracted position, and moves in a second direction from the retracted position to the extended position, the worksurface member defining an enlarged upwardly-facing upper surface;

a movement control device defining engaged and released states, wherein the movement control device permits movement of the worksurface member in the first direction when in the engaged state and when in the released state, the movement control device selectively restricting movement of the worksurface member in the second direction when the movement control device is in the engaged state and permitting movement in the first direction when the movement control device is in the engaged state to retain the worksurface member in the retracted position and to prevent movement in the second direction when the worksurface is at a selected one of the intermediate positions.

* * * * *